US011468833B2

(12) United States Patent
Lee et al.

(10) Patent No.: US 11,468,833 B2
(45) Date of Patent: Oct. 11, 2022

(54) METHOD OF CONTROLLING THE TRANSITION BETWEEN DIFFERENT REFRESH RATES ON A DISPLAY DEVICE

(71) Applicant: Samsung Electronics Co., Ltd., Suwon-si (KR)

(72) Inventors: Minwoo Lee, Suwon-si (KR); Seungryeol Kim, Suwon-si (KR); Seungjin Kim, Suwon-si (KR); Junghyun Kim, Suwon-si (KR); Byungduk Yang, Suwon-si (KR); Gwanghui Lee, Suwon-si (KR); Seoyoung Lee, Suwon-si (KR); Juseok Lee, Suwon-si (KR); Woojun Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/267,384

(22) PCT Filed: Jan. 28, 2021

(86) PCT No.: PCT/KR2021/001130
§ 371 (c)(1),
(2) Date: Feb. 9, 2021

(87) PCT Pub. No.: WO2021/157950
PCT Pub. Date: Aug. 12, 2021

(65) Prior Publication Data

US 2022/0114956 A1 Apr. 14, 2022

(30) Foreign Application Priority Data

Feb. 6, 2020 (KR) ..... 10-2020-0014551
Feb. 10, 2020 (KR) ..... 10-2020-0015954
Feb. 11, 2020 (KR) ..... 10-2020-0016605

(51) Int. Cl.
*G09G 3/3225* (2016.01)
*G09G 3/20* (2006.01)

(52) U.S. Cl.
CPC ..... *G09G 3/3225* (2013.01); *G09G 3/20* (2013.01); *G09G 2310/0267* (2013.01);
(Continued)

(58) Field of Classification Search
CPC ..... G09G 2340/0435; G09G 2320/0247
See application file for complete search history.

(56) References Cited

U.S. PATENT DOCUMENTS 8,884,977 B2 11/2014 Wang
8,902,207 B2 12/2014 Ryu et al.
(Continued)

FOREIGN PATENT DOCUMENTS

KR 10-2008-0040281 A 5/2008
KR 10-2008-0055133 A 6/2008
(Continued)

OTHER PUBLICATIONS

US 8,896,514 B2, 11/2014, Han et al. (withdrawn)
(Continued)

*Primary Examiner* — Sepehr Azari
(74) *Attorney, Agent, or Firm* — Jefferson IP Law, LLP

(57) ABSTRACT

An electronic device is provided. The electronic device includes a display panel and a display driver integrated circuit configured to drive the display panel. The display driver integrated circuit is configured to determine a luminance value of the display panel if a request for a change from a current driving frequency of the display panel to a target driving frequency is received, and determine at least one intermediate driving frequency between the current driving frequency and the target driving frequency depending on the luminance value of the display panel.

20 Claims, 11 Drawing Sheets

| LUMINANCE | CURRENT DRIVING FREQUENCY | INTERMEDIATE DRIVING FREQUENCY | | | TARGET DRIVING FREQUENCY |
|---|---|---|---|---|---|
| 420nit | 60Hz | 70Hz | 100Hz | 110Hz | 120Hz |
| 100nit | 60Hz | 70Hz | 110Hz | | 120Hz |

<501>

| LUMINANCE | CURRENT DRIVING FREQUENCY | INTERMEDIATE DRIVING FREQUENCY | | | TARGET DRIVING FREQUENCY |
|---|---|---|---|---|---|
| 420nit | 60Hz | 70Hz | 90Hz | 110Hz | 120Hz |
| 80nit | 60Hz | 90Hz | 100Hz | 110Hz | 120Hz |

<503>

| LUMINANCE | CURRENT DRIVING FREQUENCY | INTERMEDIATE DRIVING FREQUENCY | | | TARGET DRIVING FREQUENCY |
|---|---|---|---|---|---|
| 420nit | 60Hz | 70Hz | 100Hz | 110Hz | 120Hz |
| HOLDING TIME (NUMBER OF FRAMES) | | 2 | 2 | 2 | |
| 100nit | 60Hz | 70Hz | 110Hz | | 120Hz |
| HOLDING TIME (NUMBER OF FRAMES) | | 4 | 4 | | |

<505>

(52) U.S. Cl.
CPC . *G09G 2310/08* (2013.01); *G09G 2320/0247* (2013.01); *G09G 2320/0276* (2013.01); *G09G 2320/0606* (2013.01); *G09G 2320/0626* (2013.01); *G09G 2320/0673* (2013.01); *G09G 2330/028* (2013.01); *G09G 2360/16* (2013.01)

(56) References Cited

U.S. PATENT DOCUMENTS

| | | | | |
|---|---|---|---|---|
| 9,019,188 | B2 | 4/2015 | Han et al. | |
| 9,240,031 | B1 | 1/2016 | Wang | |
| 9,299,301 | B2 | 3/2016 | Choi et al. | |
| 9,318,069 | B2 | 4/2016 | Nambi et al. | |
| 9,378,697 | B2 | 6/2016 | Fujioka et al. | |
| 9,501,993 | B2 | 11/2016 | Nambi et al. | |
| 9,524,694 | B2 | 12/2016 | Wang et al. | |
| 9,601,074 | B2 | 3/2017 | Fujioka et al. | |
| 9,672,792 | B2 | 6/2017 | Choi et al. | |
| 9,697,758 | B2 | 7/2017 | Watanabe et al. | |
| 9,761,201 | B2 | 9/2017 | Tanaka et al. | |
| 9,847,056 | B2 | 12/2017 | Shimizu et al. | |
| 9,865,231 | B2 | 1/2018 | Kim et al. | |
| 9,953,613 | B2 | 4/2018 | Sacchetto et al. | |
| 9,984,664 | B2 | 5/2018 | Glen et al. | |
| 10,019,968 | B2 | 7/2018 | Bi et al. | |
| 10,043,492 | B2 | 8/2018 | Woo et al. | |
| 10,049,642 | B2 | 8/2018 | Ansari | |
| 10,056,050 | B2 | 8/2018 | Nambi et al. | |
| 10,096,080 | B2 | 10/2018 | Kwa et al. | |
| 10,210,845 | B2 | 2/2019 | Glen et al. | |
| 10,553,149 | B2 | 2/2020 | Bae et al. | |
| 10,580,336 | B2 | 3/2020 | Jang et al. | |
| 10,600,379 | B2 | 3/2020 | Nambi et al. | |
| 10,692,456 | B2 | 6/2020 | Choi et al. | |
| 10,755,622 | B2 | 8/2020 | Kong et al. | |
| 10,950,206 | B2 | 3/2021 | Kim et al. | |
| 11,120,734 | B2 | 9/2021 | Bae et al. | |
| 2008/0106542 | A1 | 5/2008 | Park et al. | |
| 2011/0057917 | A1 | 3/2011 | Ryu et al. | |
| 2014/0055476 | A1 | 2/2014 | Wang | |
| 2014/0267370 | A1* | 9/2014 | Albrecht | G09G 5/006 345/602 |
| 2014/0267448 | A1* | 9/2014 | Albrecht | G09G 3/3406 345/84 |
| 2014/0368492 | A1 | 12/2014 | Fujioka et al. | |
| 2015/0130823 | A1* | 5/2015 | Kim | G09G 3/3225 345/82 |
| 2015/0248873 | A1 | 9/2015 | Tanaka et al. | |
| 2015/0287352 | A1 | 10/2015 | Watanabe et al. | |
| 2015/0379665 | A1 | 12/2015 | Kwa et al. | |
| 2016/0093248 | A1 | 3/2016 | Shimizu et al. | |
| 2016/0125785 | A1 | 5/2016 | Wang et al. | |
| 2016/0275905 | A1 | 8/2016 | Sacchetto et al. | |
| 2016/0267870 | A1 | 9/2016 | Fujioka et al. | |
| 2016/0275916 | A1 | 9/2016 | Glen et al. | |
| 2016/0329033 | A1 | 11/2016 | Woo et al. | |
| 2017/0193971 | A1 | 7/2017 | Bi et al. | |
| 2018/0018910 | A1 | 1/2018 | Jang et al. | |
| 2018/0053463 | A1 | 2/2018 | Kong et al. | |
| 2018/0174551 | A1 | 6/2018 | Ansari | |
| 2018/0247616 | A1 | 8/2018 | Glen et al. | |
| 2018/0301121 | A1 | 10/2018 | Kim et al. | |
| 2018/0350313 | A1* | 12/2018 | Nambi | G09G 3/36 |
| 2019/0057643 | A1 | 2/2019 | Bae et al. | |
| 2019/0371264 | A1* | 12/2019 | Koo | G09G 5/006 |
| 2020/0043432 | A1 | 2/2020 | Choi et al. | |
| 2021/0183290 | A1* | 6/2021 | Sato | G09G 3/20 |
| 2021/0201738 | A1* | 7/2021 | Song | G09G 3/20 |
| 2021/0201793 | A1* | 7/2021 | Lin | G09G 3/3258 |

FOREIGN PATENT DOCUMENTS

| | | | |
|---|---|---|---|
| KR | 10-2011-0026152 | A | 3/2011 |
| KR | 10-1076445 | B1 | 10/2011 |
| KR | 10-2011-0136775 | A | 12/2011 |
| KR | 10-2015-0055503 | A | 5/2015 |
| KR | 10-2015-0068475 | A | 6/2015 |
| KR | 10-2016-0053377 | A | 5/2016 |
| KR | 10-2017-0098314 | A | 8/2017 |
| KR | 10-1774127 | B1 | 9/2017 |
| KR | 10-1954934 | B1 | 3/2019 |
| KR | 10-1992879 | B1 | 6/2019 |
| KR | 10-2020-0010689 | A | 1/2020 |

OTHER PUBLICATIONS

International Search Report dated May 28, 2021, issued in International Application No. PCT/KR2021/001583.
International Search Report dated May 28, 2021, issued in International Application No. PCT/KR2021/001574.
International Search Report dated Jun. 4, 2021, issued in International Application No. PCT/KR2021/001130.
U.S. Notice of Allowance dated Mar. 3, 2022, issued in U.S. Appl. No. 17/270,687.

* cited by examiner

| LUMINANCE | CURRENT DRIVING FREQUENCY | INTERMEDIATE DRIVING FREQUENCY | | | TARGET DRIVING FREQUENCY |
|---|---|---|---|---|---|
| 420nit | 60Hz | 70Hz | 100Hz | 110Hz | 120Hz |
| 100nit | 60Hz | 70Hz | 110Hz | | 120Hz |

<501>

| LUMINANCE | CURRENT DRIVING FREQUENCY | INTERMEDIATE DRIVING FREQUENCY | | | TARGET DRIVING FREQUENCY |
|---|---|---|---|---|---|
| 420nit | 60Hz | 70Hz | 90Hz | 110Hz | 120Hz |
| 80nit | 60Hz | 90Hz | 100Hz | 110Hz | 120Hz |

<503>

| LUMINANCE | CURRENT DRIVING FREQUENCY | INTERMEDIATE DRIVING FREQUENCY | | | TARGET DRIVING FREQUENCY |
|---|---|---|---|---|---|
| 420nit | 60Hz | 70Hz | 100Hz | 110Hz | 120Hz |
| HOLDING TIME (NUMBER OF FRAMES) | | 2 | 2 | 2 | |
| 100nit | 60Hz | 70Hz | 110Hz | | 120Hz |
| HOLDING TIME (NUMBER OF FRAMES) | | 4 | 4 | | |

<505>

FIG.5

| 420nit | | | | | |
|---|---|---|---|---|---|
| | 60Hz | 70Hz | 100Hz | 110Hz | 120Hz |
| VFP | | 914 | 296 | 135 | |
| LIGHT EMISSION CYCLE | 4 | 4 | 2 | 2 | 2 |

<601>

| 100nit | | | | | | |
|---|---|---|---|---|---|---|
| | 60Hz | 70Hz | 100Hz | 110Hz | 120Hz | 120Hz |
| VFP | | 914 | 296 | 135 | | |
| LIGHT EMISSION CYCLE | 4 | 4 | 4 | 4 | 4 | 2 |

<603>

FIG.6

| | 420nit | | | | | 100nit | | | |
|---|---|---|---|---|---|---|---|---|---|
| DRIVING FREQUENCY | 60Hz | 70Hz | 100Hz | 110Hz | 120Hz | 60Hz | 70Hz | 110Hz | 120Hz |
| VFP | | 914 | 296 | 135 | | | 900 | 100 | |
| LIGHT EMISSION CYCLE | 4 | 2 | 2 | 2 | 2 | 4 | 4 | 4 | 2 |
| AOR | 45% | 46% | 47% | 46% | 45% | 45% | 46% | 47% | 45% |

<701>

| | 420nit | | | | | 100nit | | | | |
|---|---|---|---|---|---|---|---|---|---|---|
| DRIVING FREQUENCY | 60Hz | 70Hz | 100Hz | 110Hz | 120Hz | 60Hz | 70Hz | 100Hz | 110Hz | 120Hz |
| VFP | | 914 | 296 | 135 | | | 900 | 200 | 100 | |
| LIGHT EMISSION CYCLE | 4 | 2 | 2 | 2 | 2 | 4 | 4 | 4 | 4 | 2 |
| AOR | 45% | 46% | 46% | 46% | 45% | 45% | 46% | 47% | 46% | 45% |

<703>

FIG.7

| 420nit | | | | | |
|---|---|---|---|---|---|
| | 60Hz | 70Hz | 100Hz | 110Hz | 120Hz |
| GAMMA CORRECTION (GAMMA CORRECTION TABLE) | 60Hz GAMMA CORRECTION TABLE | 60Hz GAMMA CORRECTION TABLE | 60Hz GAMMA(>202G)<br>120Hz GAMMA(<=202G) | 120Hz GAMMA(>202G)<br>New GAMMA CORRECTION TABLE (<=202G) | 120Hz GAMMA CORRECTION TABLE |
| VFP | | 914 | 296 | 135 | |

<801>

| 100nit | | | | |
|---|---|---|---|---|
| | 60Hz | 70Hz | 110Hz | 120Hz |
| GAMMA CORRECTION (GAMMA CORRECTION TABLE) | 60Hz GAMMA CORRECTION TABLE | 60Hz GAMMA CORRECTION TABLE | 120Hz GAMMA(>202G)<br>60Hz GAMMA(<=202G) | 120Hz GAMMA CORRECTION TABLE |
| VFP | | 914 | 135 | |

<803>

FIG.8

| 50nit → | | | | | |
|---|---|---|---|---|---|
| | 60Hz | 70Hz | 100Hz | 110Hz | 120Hz |
| VFP | | 914 | 296 | 135 | |
| HOLDING TIME (NUMBER OF FRAMES) | | 4 | 4 | 4 | |

<901>

| 50nit ← | | | | | |
|---|---|---|---|---|---|
| | 60Hz | 70Hz | 100Hz | 110Hz | 120Hz |
| VFP | | 914 | 296 | 135 | |
| HOLDING TIME (NUMBER OF FRAMES) | | 8 | 8 | 8 | |

<903>

FIG.9

| LESS THAN 15 nit, 500 nit OR MORE | | | | | |
|---|---|---|---|---|---|
| | 60Hz | 70Hz | 100Hz | 110Hz | 120Hz |
| INTERMEDIATE DRIVING FREQUENCY | | X | X | X | |
| LIGHT EMISSION CYCLE | 4 | X | X | X | 2 |
| AOR | 45% | X | X | X | 45% |

FIG.10

METHOD OF CONTROLLING THE TRANSITION BETWEEN DIFFERENT REFRESH RATES ON A DISPLAY DEVICE

CROSS-REFERENCE TO RELATED APPLICATION(S)

This application is a U.S. National Stage application under 35 U.S.C. § 371 of an International application number PCT/KR2021/001130, filed on Jan. 28, 2021, which is based on and claims priority of a Korean patent application number 10-2020-0014551, filed on Feb. 6, 2020, in the Korean Intellectual Property Office, of a Korean patent application number 10-2020-0015954, filed on Feb. 10, 2020, in the Korean Intellectual Property Office, and of a Korean patent application number 10-2020-0016605, filed on Feb. 11, 2020, in the Korean Intellectual Property Office, the disclosure of each of which is incorporated by reference herein in its entirety.

BACKGROUND

1. Field

The disclosure relates to operating a display. More particularly, the disclosure relates to a driving method for a display capable of maintaining an optical characteristic of a display panel while a driving speed of the display panel is changed, and an electronic device supporting the same.

2. Description of Related Art

Electronic devices include a display panel for displaying information. Various contents may be displayed in a complex manner on the display panel. The driving speed of the display panel may be changed due to content change or for other reasons. When the driving speed of the self-luminous display panel is changed, the optical characteristic may be changed.

The above information is presented as background information only to assist with an understanding of the disclosure. No determination has been made, and no assertion is made, as to whether any of the above might be applicable as prior art with regard to the disclosure.

SUMMARY

If the optical characteristic of the display panel is changed depending on the driving speed of the display panel, the change of the optical characteristic may be recognized by the user as flickering or a screen error.

Aspects of the disclosure are to address at least the above-mentioned problems and/or disadvantages and to provide at least the advantages described below. Accordingly, an aspect of the disclosure is to provide a driving method for a display capable of maintaining an optical characteristic of a display panel while a driving speed of the display panel is changed, and an electronic device supporting the same.

Additional aspects will be set forth in part in the description which follows and, in part, will be apparent from the description, or may be learned by practice of the presented embodiments.

In accordance with an aspect of the disclosure, an electronic device is provided. The electronic device includes a display panel and a display driver integrated circuit configured to drive the display panel. The display driver integrated circuit is configured to determine a luminance value of the display panel if a request for a change from a current driving frequency of the display panel to a target driving frequency is received, and determine at least one intermediate driving frequency between the current driving frequency and the target driving frequency depending on the luminance value of the display panel.

In accordance with another aspect of the disclosure, a driving method for a display is provided. The driving method for a display includes receiving, by a display driver integrated circuit, a request for a change from a current driving frequency of a display panel to a target driving frequency, determining, by the display driver integrated circuit, a luminance value of the display panel, and determining, by the display driver integrated circuit, at least one intermediate driving frequency between the current driving frequency and the target driving frequency depending on the luminance value of the display panel.

With various embodiments of the disclosure, by maintaining the optical characteristic of the display panel even if the driving speed of the display panel is changed, it is possible for the user to view the screen without any erroneous recognition.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 5 is a diagram illustrating adjustment factors of intermediate frequencies for each luminance value in a driving method for a display according to an embodiment of the disclosure;

FIG. 6 is a diagram illustrating an adjusting light emission cycles of intermediate frequencies for each luminance value in a driving method for a display according to an embodiment of the disclosure;

FIG. 7 is a diagram illustrating setting vertical front porches (VFPs), light emission cycles, and active matrix organic light emitting diodes (AMOLED) off ratios (AORs) in a driving method for a display according to an embodiment of the disclosure;

FIG. 8 is a diagram illustrating setting gamma correction tables in a driving method for a display according to an embodiment of the disclosure;

FIG. 9 is a diagram illustrating settings depending on driving frequency change directions in a driving method for a display according to an embodiment of the disclosure;

FIG. 10 is a diagram illustrating setting a driving frequency according to application of a range value in a driving method for a display according to an embodiment of the disclosure.

The same reference numerals are used to represent the same elements throughout the drawings.

DETAILED DESCRIPTION

Figure 1:
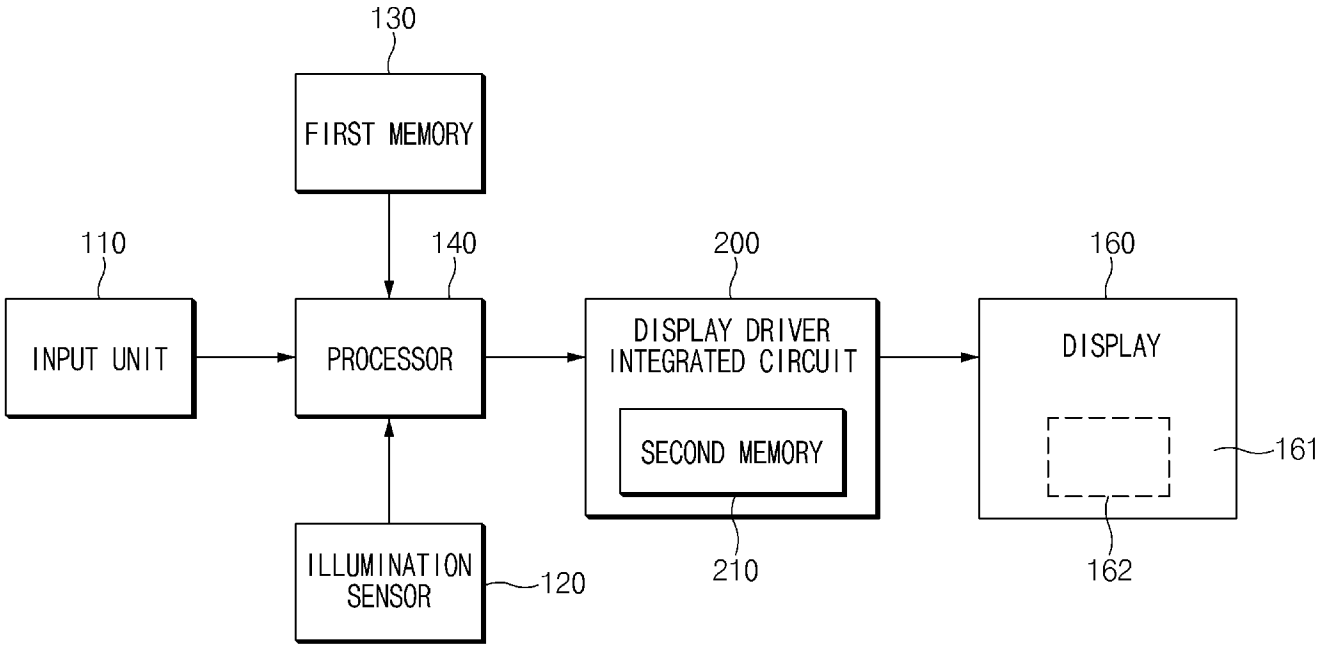
FIG. 1 is a diagram schematically illustrating a configuration of an electronic device according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

As used here, terms and phrases, such as "have", "may have", "include", or "may include" indicates the existence of features (e.g., numbers, functions, actions, or parts, such as components), and do not exclude the existence of additional features.

As used here, the phrases "A or B", "at least one of A or/and B", or "one or more of A or/and B" may include all possible combinations of the items listed together. For example, "A or B", "at least one of A and B", or "at least one of A or B" may indicate all of (1) including at least one A, (2) including at least one B, or (3) including both at least one A and at least one B.

As used here, the terms, such as "first", "second", "the first", or "the second" may modify various components, regardless of order and/or importance, and are used to distinguish one component from another, but does not limit the components. For example, the first user device and the second user device may indicate different user devices regardless of order or importance. For example, without departing from the teachings disclosed in the disclosure, a first element could be termed a second element, and similarly, in reverse, a second element could be termed a first element.

When a component (e.g., a first component) is referred to as being "(operatively or communicatively) coupled with/to" or "connected to" another component (e.g., a second component), it should be understood that any of the above components may be directly connected to another component, or may be connected via another component (e.g., a third component). In contrast, when a certain component (e.g., the first component) is referred to as being "directly coupled" or "directly connected" to another component (e.g., the second component), it is to be understood that no other component (e.g., the third component) intervenes between the certain component and the other component.

As used here, the phrase, "configured to (or set to)", may be interchangeably used with, for example, "suitable for", "having the capacity to", "designed to", "adapted to", "made to", or "capable of", depending on the circumstances. The phrase "configured (or set) to" may not necessarily mean only "specifically designed to" in hardware. Rather, in some circumstances, the phrase "device configured to" may mean that the device "can" perform an operation with other devices or parts. For example, the phrase "processor configured (or set) to perform A, B, and C" may mean a dedicated processor (e.g., an embedded processor) for performing corresponding operations, or a generic-purpose processor (e.g., a central processing unit (CPU) or an application processor) that performs the operations by executing one or more software programs stored in a memory device.

The terms and phrases as used here are merely provided to describe specific embodiments of the disclosure, and may not be intended to limit the scope of other embodiments. A singular form is intended to include a plural form, unless the context clearly indicates otherwise. Terms, including technical or scientific terms, as used here, may have the same meaning as commonly understood by a person skilled in the art to which the embodiments of the disclosure belong. Terms, such as those defined in commonly-used dictionaries should be interpreted as having a meaning that is consistent with their meaning in the context of the relevant art and will not be interpreted in an idealized or overly formal sense unless expressly so defined here. In some cases, even terms defined here cannot be interpreted to exclude embodiments of the disclosure.

Examples of an electronic device according to various embodiments of the disclosure may include at least one of a smartphone, a tablet personal computer (PC), a mobile phone, a video phone, an e-book reader, a desktop PC, a laptop personal computer, a netbook computer, a workstation, a server, a personal digital assistant (PDA), a portable multimedia player (PMP), moving picture experts group (MPEG-1 or MPEG-2) audio layer 3 (MP3) player, a mobile medical device, a camera, or a wearable device. According to various embodiments of the disclosure, the wearable device may include at least one of an accessory-type device (e.g., watches, rings, bracelets, anklets, necklaces, glasses, contact lenses, or head-mounted devices (HMD), a textiles or clothing integrated-type device (e.g., an electronic clothing), a body attachment-type device (e.g., skin pads or tattoo), or a bio-implantable-type device (implantable circuits).

In some embodiments of the disclosure, the electronic device may be a home appliance. The home appliance may include at least one of, for example, a television (TV), a digital video disc (DVD) player, an audio device, a refrigerator, an air conditioner, a cleaner, an oven, a microwave, a washing machine, an air purifier, a set-top box, a home automation control panel, a security control panel, a TV box (e.g., Samsung HomeSync™, Apple TV™, or Google TV™), a game console (e.g., Xbox™ or PlayStation™), an electronic dictionary, an electronic key, a camcorder, or a digital photo frame.

In an embodiment of the disclosure, the electronic device may include at least one of various medical devices (e.g., various portable medical measurement devices (such as a blood glucose meter, a heart rate monitor, a blood pressure meter, or a body temperature meter), magnetic resonance angiography (MRA), magnetic resonance imaging (MRI), a computed tomography (CT), an imaging device, a ultrasound machine, and the like), a navigation device, a global navigation satellite system (GNSS), an event data recorder (EDR), a flight data recorder (FDR), a vehicle infotainment device, an electronic device for a ship (e.g., a navigation device for a ship, a gyro-compass, and the like), avionics, a security device, an automotive head unit, a robot for home or industry, an automatic teller's machine (ATM) in banks, point of sales in a shop, or an Internet-of-things device (a light bulb, various sensors, an electric or gas meter, a sprinkler device, a fire alarm, a thermostat, a streetlamp, a toaster, a sporting goods, a hot water tank, a heater, a boiler, and the like).

According to some embodiments of the disclosure, the electronic device may include at least one of a part of furniture or a building/structure, an electronic board, an electronic signature receiving device, a projector, or various measuring devices (e.g., a water meter, an electric meter, a gas meter, or radio wavemeter, and the like). In various embodiments of the disclosure, the electronic device may one or a combination of two or more of the various devices described above. The electronic device according to some embodiments may be a flexible electronic device. Further, the electronic device according to an embodiment of the disclosure is not limited to the above-described devices, and may include a new electronic device accompanying technological development.

Hereinafter, an electronic device according to various embodiments will be described with reference to the accompanying drawings. In the disclosure, the term user may refer to a person using an electronic device or a device using the electronic device (e.g., an artificial intelligence electronic device).

FIG. 1 is a diagram schematically illustrating a configuration of an electronic device according to an embodiment of the disclosure.

Referring to FIG. 1, an electronic device 100 according to an embodiment of the disclosure may include an input unit 110, an illuminance sensor 120, a first memory 130, a processor 140, a display driver integrated circuit (IC) (DDI) 200, and a display panel 160 (or a display). In the electronic device 100, the illuminance sensor 120 may be selectively included. According to various embodiment of the disclosure, if the electronic device 100 supports a communication function, the electronic device 100 may further include at least one processor related to operating the communication function, and at least one antenna.

The input unit 110 may receive a user input and transmit the received user input to the processor 140. The input unit 110 may include, for example, at least one of a touch screen, a physical button, a touchpad, an electronic pen, and a voice input (e.g., a microphone). The input unit 110 may further include a camera. The user may generate a user input by making a specified gesture using the camera. According to an embodiment of the disclosure, the input unit 110 may receive a user input related to a luminance setting change of the display panel 160. In this regard, the display panel 160 may output a user interface related to the luminance setting change. The input unit 110 may include a touch screen capable of changing a luminance setting through the user interface. According to various embodiments of the disclosure, the input unit 110 may receive a designated user utterance related to the luminance setting change input through a microphone. According to various embodiments of the disclosure, the input unit 110 may include the illuminance sensor 120. According to an embodiment of the disclosure, the input unit 110 may further include at least one of an angle sensor (e.g., if the electronic device is a foldable electronic device, the angle sensor detects an angle to correspond to a change in luminance by opening and closing), a motion sensor, a biometric sensor, and a light sensor.

The illuminance sensor 120 is disposed on one side of the electronic device 100 to measure external illuminance. In this regard, the illuminance sensor 120 may be disposed on the rear surface of the electronic device 100, disposed on one side of the front surface, or disposed under the display panel 160. The illuminance sensor 120 may transmit the measured external illuminance to the processor 140. According to various embodiments of the disclosure, if the electronic device 100 does not include a function of measuring external illuminance, the illuminance sensor 120 may be omitted from the configuration of the electronic device 100. According to another embodiment of the disclosure, the illuminance sensor 120 may be included in the input unit 110, and in this case, the illuminance sensor 120 illustrated in FIG. 1 may be regarded as a configuration of the input unit 110.

The first memory 130 may store various data and programs related to operating the electronic device 100. For example, the first memory 130 may store an operating program related to the operation of the electronic device 100, a program related to the operation of the illuminance sensor 120, a program related to changing the luminance value of the display panel 160, and a program related to controlling the driving speed of the display panel 160. According to an embodiment of the disclosure, the first memory 130 may store a program related to generating an intermediate driving frequency for each set luminance value of the display panel 160, and a program for executing at least one of adjustment of the light emission cycle for each set luminance value of the display panel 160, adjustment of the number of vertical blanks for each set luminance value of the display panel 160, control of an AMOLED off ratio (AOR) for each set luminance value of the display panel 160, or gamma correction for each set luminance value of the display panel 160. The first memory 130 may store a plurality of gamma correction tables related to the gamma correction for each luminance value. According to various embodiments of the disclosure, the plurality of gamma correction tables may not be stored in the first memory 130, but may be stored in a second memory 210 disposed in the display driver integrated circuit 200. Alternatively, the plurality of gamma correction tables may be stored in both the first memory 130 and the second memory 210. The AOR may include any one of the ratio of time when a pixel is turned off while outputting one frame to the display panel 160, and the ratio of time when a pixel is turned off in one of the light emission cycles for outputting one frame to the display panel 160.

The processor 140 may be operatively connected with the input unit 110, the illuminance sensor 120, the first memory 130, and the display driver integrated circuit 200. The processor 140 may be involved in execution of a program stored in the first memory 130 and may transmit data necessary for driving the display panel 160 to the display driver integrated circuit 200.

According to an embodiment of the disclosure, the processor 140 may automatically control the illuminance value change of the display panel 160 based on the luminance value received from the illuminance sensor 120. For example, the processor 140 may change the luminance value of the display panel 160 to a first luminance value when the external illuminance is less than a first illuminance value (e.g., a low-illuminance environment). In addition, the processor 140 may change the luminance value of the display panel 160 to a second luminance value (e.g., a value greater than the first luminance value) when the external illuminance is equal to or greater than a second illuminance value (e.g., a high-illuminance environment). According to various embodiments of the disclosure, the processor 140 may output a user interface (UI) allowing a luminance value of the display panel 160 to be changed to the display panel 160 in response to a first user input, and may change the luminance value of the display panel 160 in response to a second user input related to the luminance value change.

According to various embodiments of the disclosure, the processor 140 may automatically change the luminance value of the display panel 160 to a specified luminance value depending on the type of content requested to be executed. For example, the processor 140 may change the luminance value of the display panel 160 to a specified second luminance value when a video content or a camera function execution is requested. The processor 140 may change the luminance value of the display panel 160 to a specified first luminance value (e.g., a value smaller than the second luminance value), when the execution of the text viewing function is requested.

When the driving frequency change (e.g., refresh rate change) of the display panel 160 is requested in a state in which the luminance value of the display panel 160 is changed due to various reasons, the processor 140 may differently determine at least one of the numbers, values, or holding times of intermediate driving frequencies between the current driving frequency and the target driving frequency (e.g., a driving frequency value requested to be changed) depending on the size of the difference between the current luminance value of the display panel 160 and the target luminance value to be changed. For example, the processor 140 may allocate a greater number of intermediate driving frequencies as the difference of the luminance values increases. In this operation, the processor 140 may perform control such that the intermediate driving frequency values and holding times are allocated evenly or unevenly, or are allocated in a linear or nonlinear increasing manner, according to the number of allocated intermediate driving frequencies.

Regarding the even allocation, the processor 140 may evenly divide values between the current driving frequency and the target driving frequency into the number of intermediate driving frequencies, and evenly allocate the holding times. Regarding the uneven allocation, the processor 140 may allocate fewer (or more) intermediate driving frequencies which are relatively low (or high), in the number of intermediate driving frequencies. Alternatively, regarding the uneven allocation, the processor 140 may allocate fewer (or more) intermediate driving frequencies which are relatively high (or low), in frequency values to be allocated to the number of intermediate driving frequencies. Regarding the linear or non-linear increasing allocation, the processor 140 may allocate intermediate frequency values so that the frequency change values of the intermediate driving frequencies between the current driving frequency and the target driving frequency increase (or decrease) linearly (or non-linearly). Alternatively, the processor 140 may perform the allocation so that the holding times of intermediate driving frequencies between the current driving frequency and the target driving frequency increase (or decrease) linearly (or non-linearly).

According to various embodiments of the disclosure, if the current driving frequency and the target driving frequency are determined, the processor 140 may determine the number of intermediate driving frequencies to be disposed between the current driving frequency and the target driving frequency. For the determined total intermediate driving frequencies, the processor 140 may allocate fewer values of the intermediate driving frequencies which are relatively small and allocate more values of the intermediate driving frequencies which are relatively large. According to various embodiments of the disclosure, the processor 140 may allocate shorter holding times for relatively small values and allocate longer holding times for relatively large values, among values of the intermediate driving frequencies. Alternatively, the processor 140 may allocate shorter holding times for the relatively small values of the intermediate driving frequencies, and may allocate longer holding times for relatively great values of the intermediate driving frequencies, depending on the number of allocated intermediate driving frequencies. Regarding the above-described operation controls, the processor 140 may employ at least one control method so as to maintain the optical characteristic while changing the current driving frequency to the target driving frequency depending on at least one of a panel characteristic of the display panel 160 and a content characteristic requested to be executed.

According to various embodiments of the disclosure, if an adjustment factor of the intermediate driving frequencies (e.g., at least one of the number, values, or holding times of the intermediate driving frequencies) is determined, the processor 140 may perform at least one of various operations related to driving the display panel 160 in response to the determination. The various operations may include, for example, at least one of the light emission cycle (e.g., adjustment of the number of duty on or off set to display one screen (or one frame)), adjustment of the number of vertical blanks (at least one of the vertical back porch or the vertical front porch) for each set luminance value of the display panel 160, control of the size of the AMOLED off ratio (AOR) (e.g., duty off size) for each set luminance value of the display panel 160, or the gamma correction for each set luminance value of the display panel 160.

The display panel 160 may display data by the display driver integrated circuit 200. According to embodiments of the disclosure, the display panel 160 may be implemented as a thin film transistor-liquid crystal display (TFT-LCD) panel, a light-emitting diode (LED) display panel, an organic LED (OLED) display panel, an active matrix OLED (AMOLED) display panel, or a flexible display panel.

In the display panel 160, gate lines and source lines may be arranged alternatively in a matrix form, for example. A gate signal may be supplied to the gate lines. According to an embodiment of the disclosure, a gate signal may be sequentially supplied to gate lines. According to various embodiments of the disclosure, a first gate signal may be supplied to odd gate lines among gate lines, and a second gate signal may be supplied to even gate lines. The first gate signal and the second gate signal may be signals that are alternately supplied. Alternatively, the first gate signal is supplied to the odd gate lines sequentially from the start line to the end line, and then the second gate signal may be supplied to the even gate lines sequentially from the start line to the end line. A signal corresponding to display data may be supplied to the source lines. The signal corresponding to the display data may be supplied from a source driver under the control of a timing controller of a logic circuit.

The display panel 160 may include light-emitting devices in which a plurality of gate lines and a plurality of source lines are arranged in a matrix form and are connected to a plurality of thin-film transistor (TFT). The display panel 160 may display a screen accompanied by execution of contents. In this operation, the display panel 160 may output a screen with the driving frequency depending on the driving of the display driver integrated circuit 200. According to various embodiments of the disclosure, the display panel 160 may include a first display region 161 on which first content is displayed and a second display region 162 on which second content is displayed. While the first content is displayed on the first display region 161, a screen may be displayed based on a first driving frequency (e.g., 60 Hz). While the second content is displayed on the second display region 162, a screen may be displayed on the display panel 160 (e.g., the first display region 161 and the second display region 162) based on a second driving frequency (e.g., 120 Hz). When playback of the second content ends, and the second display region 162 is removed and only the first display region 161 remains, the driving frequency of the display panel 160 may be changed from the second driving frequency to the first driving frequency under the control of at least one of the processor or the display driver integrated circuit. According to various embodiments of the disclosure, the second display region 162 may be output in the form of a pop-up window, may be output to one region after splitting the screen of the display panel 160, or may be output as a full screen.

According to an embodiment of the disclosure, if the driving frequency of the display panel 160 is changed from the first driving frequency to the second driving frequency, at least one of the number, values, or holding times of the intermediate driving frequencies (e.g., 70 Hz, 75 Hz, 80 Hz, 90 Hz, 100 Hz, and 110 Hz) between the first driving frequency and the second driving frequency may be applied differently depending on the current luminance value of the display panel 160. In addition, at least one of the light emission cycle, the AOR, the magnitude of the driving speed (e.g., 1H (horizontal) period, which is the time for one gate line to maintain turn-on), the number of the vertical front porches (VFPs), and the gamma correction tables, which are related to the screen display of the display panel 160, may be applied differently.

The display driver integrated circuit 200 may change the data transmitted from the processor 140 into a form capable of being transmitted to the display panel 160, and may transmit the changed data to the display panel 160. The changed data (or display data) may be supplied in pixel units (or sub-pixel units). Here, the pixel has a structure in which sub-pixels Red, Green, and Blue (RGB) are arranged adjacent to each other in relation to the specified color display, and one pixel may include RGB sub-pixels (RGB stripe layout structure) or RGBG sub-pixels (pentile layout structure). Here, the arrangement structure of the RGBG sub-pixels may be replaced with the arrangement structure of the RGGB sub-pixels. Alternatively, the pixel may have a Red, Green, Blue, and White (RGBW) sub-pixel arrangement structure as one substitute.

According to an embodiment of the disclosure, the display driver integrated circuit 200 may change the driving frequency of the display panel 160 (e.g., change from 60 Hz to 120 Hz or vice versa (change from 120 Hz to 60 Hz), change from 60 Hz to 90 Hz or vice versa, or change from 60 Hz to 30 Hz, or vice versa), depending on at least one of the type of content requested to be played back and a user setting. In this operation, the display driver integrated circuit 200 may determine the luminance value of the display panel 160, and may differently determine at least one of the number, values, or holding times of intermediate driving frequencies (frequencies between the current driving frequency and the target driving frequency), depending on the determined luminance value. If the adjustment factors (e.g., at least one of the number, values, or holding times) of the intermediate driving frequencies are determined, the display driver integrated circuit 200 may adjust the adjustment factor related to the screen display of the display panel 160 (e.g., at least one of the light emission cycle, the AOR, the magnitude of the driving speed (e.g., 1H (horizontal) period, the number of the vertical front porches (VFPs), and the gamma correction tables) so that the optical characteristics of the determined intermediate driving frequencies maintain the optical characteristic of the current display panel 160 (for example, so that the luminance value of the display panel 160 is the same or similar at each driving frequency). The determining of the adjustment factor of the intermediate driving frequencies of the display driver integrated circuit 200 and the determining of the adjustment factor related to the screen display at each driving frequency for maintaining the optical characteristic may be performed under the control of the processor 140 or may be performed by the logic circuit (or the timing controller) of the display driver integrated circuit 200.

As described above, the electronic device 100 according to an embodiment of the disclosure may maintain the optical characteristic of the display panel 160 by changing the driving frequency (e.g., refresh rate, R/R) of the display panel 160 corresponding to the change in luminance value.

Figure 2:
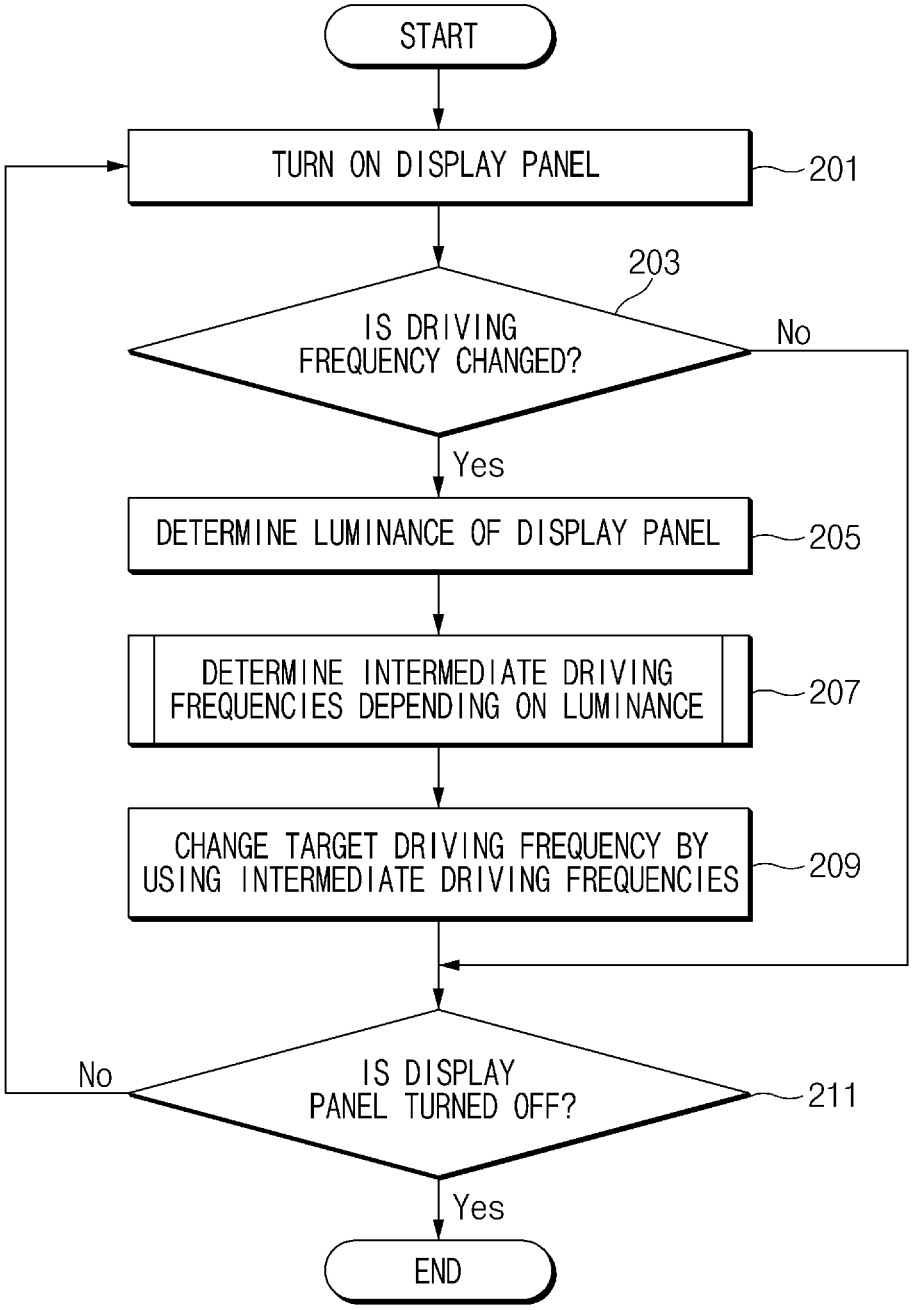
FIG. 2 is a diagram illustrating a driving method for a display according to an embodiment of the disclosure.

FIG. 2 is a diagram illustrating a driving method for a display according to an embodiment of the disclosure.

Referring to FIG. 2, in a driving method for a display according to an embodiment of the disclosure, in operation 201, the display driver integrated circuit 200 may turn on the display panel 160 or maintain the turn-on state of the display panel 160. According to an embodiment of the disclosure, the display driver integrated circuit 200 may perform control to output, to the display panel 160 of the turn-on state, a screen accompanied by execution of specific content or application.

In operation 203, the display driver integrated circuit 200 may determine whether or not an event related to changing the driving frequency occurs. For example, the display driver integrated circuit 200 may receive, from the processor 140, instructions related to changing the driving frequency. Alternatively, the display driver integrated circuit 200 may receive, from the processor 140, a request for outputting a content screen, which is set to operate at a driving frequency different from the driving frequency applied to the contents currently displayed on the display panel 160.

If the event related to changing the driving frequency occurs, in operation 205, the display driver integrated circuit 200 may determine the luminance value of the display panel 160. For example, the display driver integrated circuit 200 may determine the current luminance value of the display panel 160 based on a signal supplied to the display panel 160. According to various embodiments of the disclosure, the display driver integrated circuit 200 may receive, from the processor 140, a current luminance setting value of the display panel 160. The processor 140 may transmit the luminance setting value to the display driver integrated circuit 200 at a time point when the luminance setting value is changed, or may transmit the luminance setting value to the display driver integrated circuit 200 at a time point when the driving frequency of the display panel 160 is changed. Regarding the luminance setting, the processor 140 may automatically control the adjustment of the luminance setting value of the display panel 160 based on the external illuminance obtained by the illuminance sensor 120 and a previously stored luminance adjustment table. Alternatively, the processor 140 may output a screen interface related to the luminance setting with a user input, and may change the luminance setting value with a user input corresponding to a change in luminance value.

In operation 207, the display driver integrated circuit 200 may determine intermediate driving frequencies depending on the luminance value (or luminance setting value) of the display panel 160. For example, the display driver integrated circuit 200 may determine at least one of the number, values, and holding times of intermediate driving frequencies, which are included in the adjustment factors of the intermediate driving frequencies.

In operation 209, the display driver integrated circuit 200 may change the current driving frequency of the display panel 160 to a target driving frequency as the change target, by using the intermediate driving frequencies. In this operation, the display driver integrated circuit 200 may control the optical characteristic of the display panel 160 to be maintained while changing the current driving frequency to the target driving frequency through the intermediate driving frequencies.

In operation 211, the display driver integrated circuit 200 may determine whether or not an event related to turn-off of the display panel 160 occurs. If an event related to turn-off of the display panel 160 occurs, the display driver integrated circuit 200 may end the driving of the display panel 160. If the event related to the turn-off of the display panel 160 does not exist, the process branches before operation 201 and the display driver integrated circuit 200 may re-perform the subsequent operations.

Figure 3:
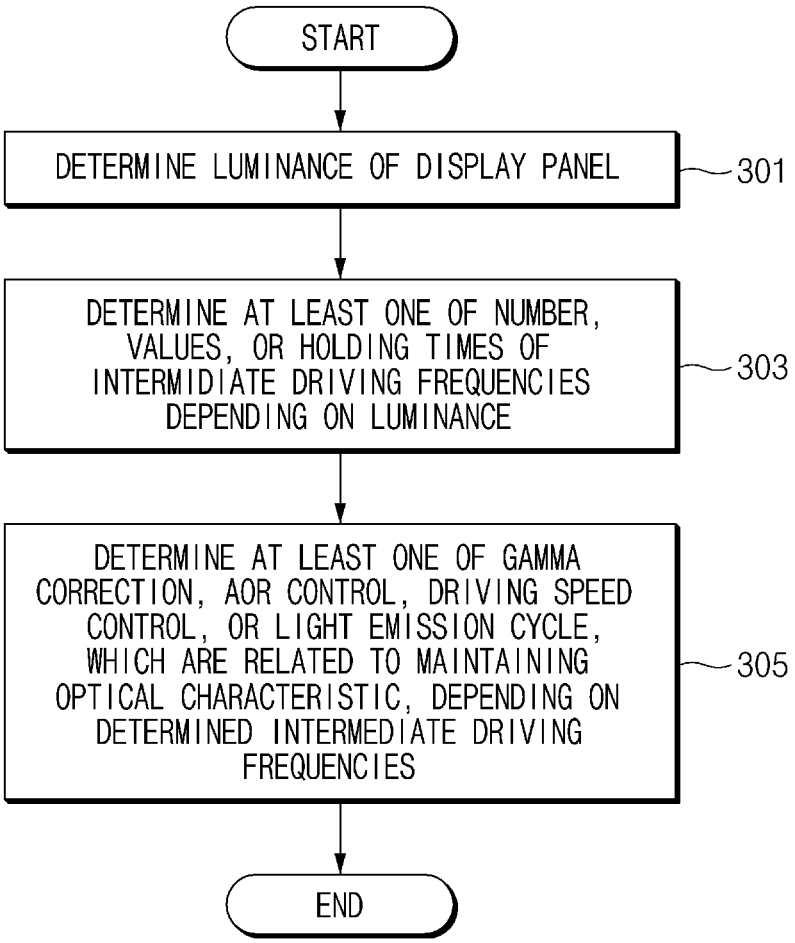
FIG. 3 is a diagram illustrating operation 207 of FIG. 2 in a driving method for a display according to an embodiment of the disclosure.

FIG. 3 is a diagram illustrating operation 207 of FIG. 2 in a driving method for a display according to an embodiment of the disclosure.

Referring to FIG. 3, in operation 301, the display driver integrated circuit 200 may determine the luminance value of the display panel 160. For example, the display driver integrated circuit 200 may receive, from the processor 140, a luminance setting value of the display panel 160. Alternatively, the display driver integrated circuit 200 may determine a luminance value based on at least some signals supplied to the display panel 160. The processor 140 may automatically adjust the luminance value of the display panel 160 based on a previously stored luminance value adjustment table according to an external illuminance value obtained from the illuminance sensor 120. Alternatively, the processor 140 may change the luminance setting value depending on a user input. Alternatively, the processor 140 may change the luminance setting value depending on the type of content being executed. If the luminance setting value is changed, the processor 140 may provide the changed luminance value to the display driver integrated circuit 200. Alternatively, if the change in the driving frequency occurs, the processor 140 may determine the luminance setting value of the display panel 160 and may provide, to the display driver integrated circuit 200, the target driving frequency value as the change target together with the luminance setting value.

In operation 303, the display driver integrated circuit 200 may determine at least one of the number, values, or holding times of the intermediate driving frequencies with the luminance value currently applied to the display panel 160 depending on the luminance setting value. For example, the display driver integrated circuit 200 may allocate n numbers of intermediate driving frequencies when the current luminance value (or luminance setting value) of the display panel 160 is a first luminance value, and may allocate m (e.g., a natural number different from n) numbers of intermediate driving frequencies when the luminance value (or luminance setting value) of the display panel 160 is a second luminance value (e.g., a value greater than the first luminance value). According to an embodiment of the disclosure, the display driver integrated circuit 200 may allocate relatively many intermediate driving frequencies when the luminance value of the display panel 160 is relatively high, and may allocate relatively few intermediate driving frequencies when the luminance value thereof is relatively low. Alternatively, depending on the characteristic of the display panel 160, the display driver integrated circuit 200 may allocate relatively few intermediate driving frequencies when the luminance value of the display panel 160 is relatively low, and may allocate relatively many intermediate driving frequencies when the luminance value thereof is relatively high.

According to various embodiments of the disclosure, the display driver integrated circuit 200 may allocate values of intermediate driving frequencies within a range between the current driving frequency and the target driving frequency by even or non-even division. For example, the display driver integrated circuit 200 may perform even division if the difference between the current driving frequency and the target driving frequency is within a first range, and may perform uneven division if the difference is a second range greater than the first range. In the uneven division, the display driver integrated circuit 200 may allocate fewer driving frequency values which are relatively low, and more driving frequency values which are relatively high. Alternatively, depending on the characteristic of the display panel 160, in the uneven division, the display driver integrated circuit 200 may allocate more driving frequency values which are relatively low and may allocate fewer driving frequency values which are relatively high.

According to various embodiments of the disclosure, the display driver integrated circuit 200 may evenly allocate or unevenly allocate holding times of intermediate driving frequencies. For example, the display driver integrated circuit 200 may evenly allocate the holding times of the respective driving frequencies if the difference value between the current driving frequency and the target driving frequency is within the first range, and may unevenly allocate the holding times of the respective driving frequencies if the difference is a second range greater than the first range. According to an embodiment of the disclosure, the display driver integrated circuit 200 may allocate a shorter holding time for the driving frequency which is relatively low, and may allocate a longer holding time for the driving frequency which is relatively high. Alternatively, depending on the characteristic of the display panel 160, the display driver integrated circuit 200 may allocate a longer holding time for the driving frequency which is relatively low, and may allocate a shorter holding time for the driving frequency which is relatively high.

In operation 305, the display driver integrated circuit 200 may determine at least one of gamma correction, AOR control, driving speed control, or light emission cycle control, which are related to maintaining an optical characteristic, depending on the determined intermediate driving frequency.

For example, the display driver integrated circuit 200 may set a period of the light emission cycle to be relatively short if the number of intermediate driving frequencies is relatively large, and may set the period of the light emission cycle to be relatively long if the number of intermediate driving frequencies is relatively small. Alternatively, depending on the characteristic of the display panel 160, the display driver integrated circuit 200 may set the period of the light emission cycle to be relatively long if the number of intermediate driving frequencies is relatively large, and may set the period of the light emission cycle to be relatively short if the number of intermediate driving frequencies is relatively small.

According to various embodiments of the disclosure, the display driver integrated circuit 200 may set the AOR to be shorter (reduce the off ratio) if the number of intermediate driving frequencies is relatively large, and may set the AOR to be longer (increase the off ratio) if the number of intermediate driving frequencies is relatively small. Alternatively, depending on the characteristic of the display panel 160, the display driver integrated circuit 200 may set the AOR to be relatively long if the number of intermediate driving frequencies is relatively large, and may set the AOR to be relatively short if the number of intermediate driving frequencies is relatively small.

According to various embodiments of the disclosure, the display driver integrated circuit 200 may set the driving speed (e.g., 1H time or the number of VFPs) to be relatively short if the number of intermediate driving frequencies is relatively large. The display driver integrated circuit 200 may set the driving speed (e.g., 1H time or the number of VFPs) to be relatively long if the number of intermediate driving frequencies is relatively small. Alternatively, depending on the characteristic of the display panel 160, the display driver integrated circuit 200 may set the driving speed (e.g., 1H time or VFP number) to be relatively long if the number of intermediate driving frequencies is relatively large, and may set the driving speed (e.g., 1H time or the number of VFOs) to be relatively short if the number of intermediate driving frequencies is relatively small. According to various embodiments of the disclosure, the display driver integrated circuit 200 may set the driving speed to be relatively short (or long) if the value of the target driving frequency is relatively large, and may set the driving speed to be relatively long (or short) if the value of the target driving frequency is relatively small.

According to various embodiments of the disclosure, the display driver integrated circuit 200 may store a gamma correction table corresponding to each of the intermediate driving frequencies in advance, and may apply the corresponding gamma correction table with the determination of the intermediate driving frequencies by the processor. Alternatively, the display driver integrated circuit 200 may perform the gamma correction on a first intermediate driving frequency without the gamma correction table by using gamma correction tables of other adjacent intermediate driving frequencies (e.g., in case of 70 Hz, the gamma correction table for 60 Hz and the gamma correction table for 80 Hz). In this operation, the display driver integrated circuit 200 may apply an arithmetic average value of values of two gamma correction tables as the gamma correction value of the first intermediate driving frequency.

The display driver integrated circuiting circuit 200 may selectively operate at least one of the light emission cycle, the AOR, the driving speed, and the gamma correction described above to perform control such that the luminance values of the display panel 160 at intermediate driving frequencies is at the current driving frequency are the same as or similar to the luminance value of the display panel 160 at the current driving frequency. Alternatively, the display driver integrated circuit 200 may adjust at least one of the light emission cycle, the AOR, the driving speed, and the gamma correction, based on the adjustment table for values of the current driving frequency and target driving frequency and the luminance value of the current display panel 160.

Figure 4:
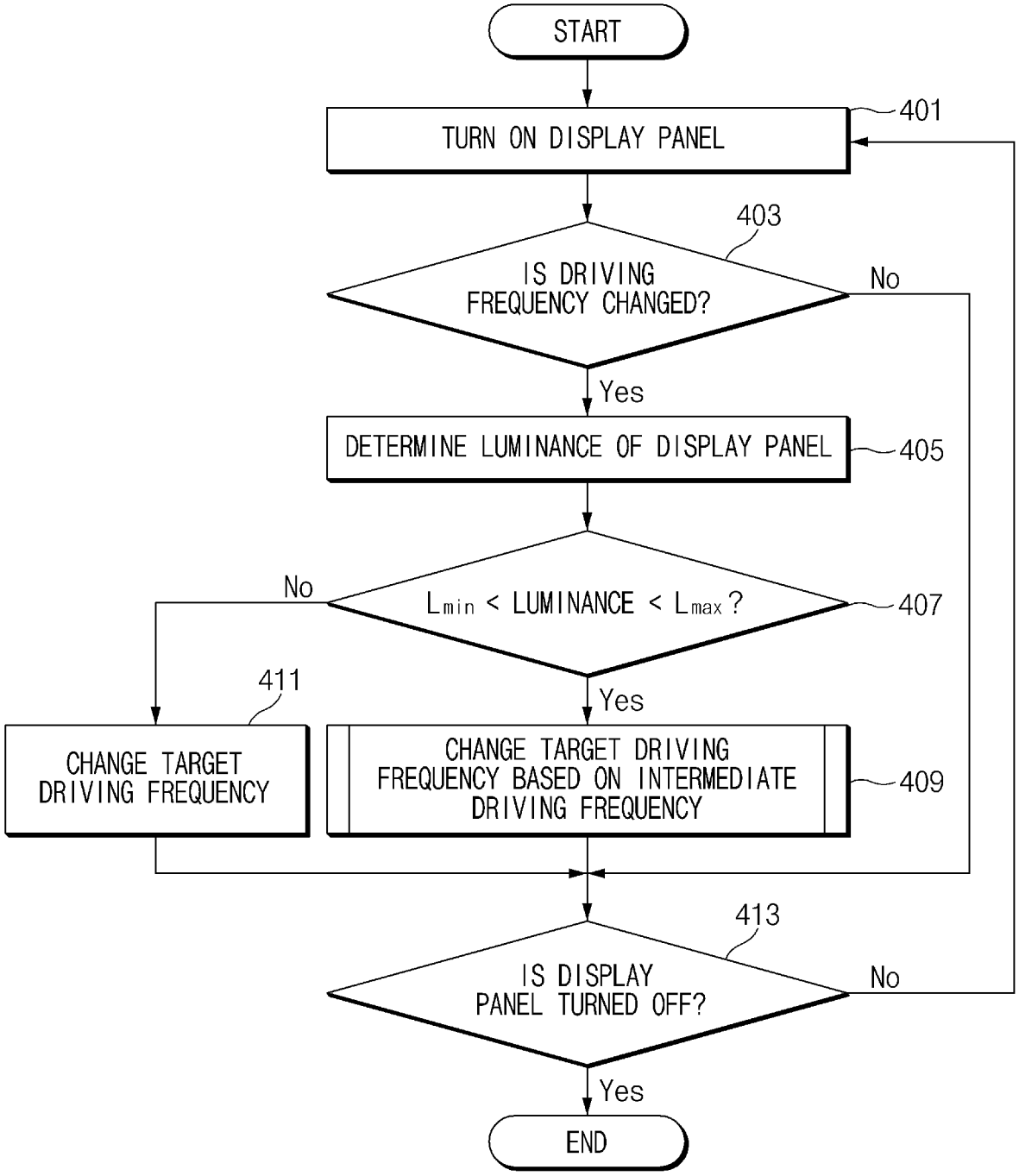
FIG. 4 is a diagram illustrating a driving method for a display according to an embodiment of the disclosure.

FIG. 4 is a diagram illustrating a driving method for a display according to an embodiment of the disclosure.

Referring to FIG. 4, regarding the driving method for the display according to an embodiment of the disclosure, in operation 401, the display driver integrated circuit 200 may output a screen (or a frame) accompanied by the playback of contents on the display panel 160 by turning on the display panel 160 or while maintaining the turn-on state.

In operation 403, the display driver integrated circuit 200 may determine whether or not an event related to changing the driving frequency occurs. The occurrence of an event related to changing the driving frequency may include, for example, receiving an instruction related to changing the driving frequency from the processor 140.

If the event related to changing the driving frequency occurs, in operation 405, the display driver integrated circuit 200 may determine the luminance value of the display panel 160 through the determining of at least some signals supplied to the display panel 160. Alternatively, the display driver integrated circuit 200 may determine the luminance setting value of the display panel 160 received from the processor 140. In this operation, the display driver integrated circuit 200 may include the second memory 210 and store and manage the luminance setting value of the display panel 160 in the second memory 210. The luminance setting value of the display panel 160 stored in the second memory 210 may be updated in real time with the change of the luminance setting value of the display panel 160, or at a time point when the driving frequency of the display panel 160 is changed.

In operation 407, the display driver integrated circuit 200 may determine whether the current luminance value of the display panel 160 is between a specified minimum value Lmin and a specified maximum value Lmax. The specified minimum value Lmin and maximum value Lmax may vary depending on at least one of a panel characteristic of the display panel 160, a usage time of the display panel 160, and types of executed contents.

If the luminance value of the display panel 160 exists between the minimum value Lmin and the maximum value Lmax, in operation 409, the display driver integrated circuit 200 may change the current driving frequency to the target driving frequency based on the intermediate driving frequency. In the process of changing, the display driver integrated circuit 200 may adjust at least one of the light emission cycle, the AOR, the driving speed, and the gamma correction table at each driving frequency (e.g., intermediate driving frequency and target driving frequency) in order to maintain the optical characteristic of the display panel 160. Operation 409 may include operations of determining the adjustment factor of the intermediate driving frequency and determining the adjustment factor related to screen display at each driving frequency for maintaining the optical characteristic of the display panel 160, which are described above with reference to FIG. 3.

If the luminance value of the display panel 160 does not exist between the minimum value Lmin and the maximum value Lmax, in operation 411, the display driver integrated circuit 200 may perform the change to the target driving frequency without determining and applying any separate intermediate driving frequency. For example, if the luminance value of the display panel 160 is less than or equal to the minimum value Lmin or equal to or greater than the maximum value, the display driver integrated circuit 200 may perform the change to the target driving frequency without employing any separate intermediate driving frequency. According to various embodiments of the disclosure, the display driver integrated circuit 200 may adjust at least one of the light emission cycle, the AOR, the driving speed, and the gamma correction table of the display panel 160 at the target driving frequency when the change to the target driving frequency is performed, and thus may perform control such that the optical characteristic of the display panel 160 at the target driving frequency is the same as or similar to the optical characteristic of the display panel 160 at the current driving frequency. According to various embodiments of the disclosure, the display driver integrated circuit 200 may store the adjustment table (the adjustment table defining adjustment values of the light emission cycle, the AOR, the driving speed, and the gamma correction table when changing the current driving frequency to the target driving frequency for each luminance value of the display panel 160) in the second memory 210, and may process the application of the light emission cycle, the AOR, the driving speed, and the gamma correction table at the target driving frequency based on the adjustment table.

In operation 413, the display driver integrated circuit 200 may determine whether or not an event related to turn-off of the display panel 160 occurs. If the event related to the turn-off of the display panel 160 does not occur, the process branches before operation 401 and the display driver integrated circuit 200 may perform control to re-perform subsequent operations. If the event related to the turn-off of the display panel 160 occurs, the display driver integrated circuit 200 may turn off the display panel 160 and may end the operation related to driving the display panel 160.

FIG. 5 is a diagram illustrating determining adjustment factors of intermediate frequencies for each luminance value in a driving method for a display according to an embodiment of the disclosure.

Referring to FIG. 5, as in 501, the display driver integrated circuit 200 may allocate three intermediate driving frequencies (e.g., 70 Hz, 100 Hz, and 110 Hz) when the luminance value of the display panel 160 is 420 nit, the current driving frequency is 60 Hz, and the target driving frequency is 120 Hz. Accordingly, the display driver integrated circuit 200 may change the driving frequency of the display panel 160 from 60 Hz to 120 Hz through intermediate driving frequencies of 70 Hz, 100 Hz, and 110 Hz. According to an embodiment of the disclosure, the display driver integrated circuit 200 may allocate two intermediate driving frequencies (e.g., 70 Hz and 110 Hz) when the luminance value of the display panel 160 is 100 nit, the current driving frequency is 60 Hz, and the target driving frequency is 120 Hz. Accordingly, the display driver integrated circuit 200 may change the driving frequency of the display panel 160 from 60 Hz to 120 Hz through intermediate driving frequencies of 70 Hz and 110 Hz. Here, the intermediate driving frequencies are provided as examples, and the display driver integrated circuit 200 may allocate different values, such as 75 Hz, 80 Hz, 90 Hz, 95 Hz, and so on.

According to various embodiments of the disclosure, as in 503, the display driver integrated circuit 200 may employ 70 Hz, 90 Hz, and 110 Hz as the allocated intermediate driving frequencies when the luminance value of the display panel 160 is 420 nit, the current driving frequency is 60 Hz, and the target driving frequency is 120 Hz. The display driver integrated circuit 200 may allocate three intermediate driving frequencies when the luminance value of the display panel 160 is 80 nit, the current driving frequency is 60 Hz, and the target driving frequency is 120 Hz, but the intermediate driving frequencies may have different values (e.g. 80 Hz, 90 Hz, and 110 Hz) from when the luminance value of the display panel 160 is 400 nit. Since problems, such as flicker are relatively less prominent in a low luminance environment, the display driver integrated circuit 200 may allocate more intermediate driving frequencies which are relatively high if the luminance value of the display panel 160 is relatively low as described above.

According to various embodiments of the disclosure, as in 505, the display driver integrated circuit 200 may employ 70 Hz, 100 Hz, and 110 Hz as the allocated intermediate driving frequencies when the luminance value of the display panel 160 is 420 nit, the current driving frequency is 60 Hz, and the target driving frequency is 120 Hz, and may set holding times of the intermediate driving frequencies (numbers of frames to be displayed at the driving frequencies) to operate as 2, 2, and 2, respectively. Here, the operation as 2, 2, and 2 may mean an operation of outputting two frames at 70 Hz, outputting two frames at 100 Hz, and then outputting two frames at 110 Hz. The display driver integrated circuit 200 may allocate 70 Hz and 110 Hz as the intermediate driving frequencies when the luminance value of the display panel 160 is 100 nit, the current driving frequency is 60 Hz, and the target driving frequency is 120 Hz, but may operate the holding times of the driving frequencies to operate as 4 and 4, respectively. Here, the operation as 4 and 4 may mean an operation of outputting four frames at 70 Hz, and outputting four frames at 110 Hz. As described above, since problems, such as flicker are relatively less prominent in a low luminance environment, the display driver integrated circuit 200 may allocate fewer intermediate driving frequencies or more driving frequencies which are relatively high, if the luminance value of the display panel 160 is relatively low.

FIG. 6 is a diagram illustrating adjusting light emission cycles of intermediate frequencies for each luminance value in a driving method for a display according to an embodiment of the disclosure.

Referring to FIG. 6, as in 601, the display driver integrated circuit 200 may allocate three intermediate driving frequencies of 70 Hz, 100 Hz, and 110 Hz and may allocate 914, 296, and 135 as values of the vertical front porches (VFPs) of the three intermediate driving frequencies, respectively, when the luminance value of the display panel 160 is 420 nit, the current driving frequency is 60 Hz, and the target driving frequency is 120 Hz. The VFP may be a value related to a time for maintaining one frame. For example, the VFP may include a value obtained by giving a pause time from the time when displaying one frame to before the time when displaying the next frame in units of gate lines. For the VFP, a value for maintaining the corresponding frame to be displayed longer may be applied when the VFP is relatively large, and a value for maintaining the corresponding frame to be displayed shorter may be applied when the VFP is relatively small. The display driver integrated circuit 200 may set the light emission cycles for the driving frequencies of 60 Hz, 70 Hz, 100 Hz, 110 Hz, and 120 Hz, and 120 Hz to 4 (four times on-off repetition during one frame output, period/frame), 4, 2, 2, and 2, respectively. Here, the light emission cycle may include a cycle (e.g., a duty ratio) in which power is supplied to pixels of the display panel 160 during displaying one frame. For example, four setting may include setting for displaying one frame through four on-off operations.

As in 603, the display driver integrated circuit 200 may allocate four intermediate driving frequencies of 70 Hz, 100 Hz, 110 Hz, and 120 Hz when the luminance value of the display panel 160 is 100 nit, the current driving frequency is 60 Hz, and the target driving frequency is 120 Hz. The display driver integrated circuit 200 may set the light emission cycles for the driving frequencies of 60 Hz, 70 Hz, 100 Hz, 110 Hz, 120 Hz, and 120 Hz to 4, 4, 4, 4, 4, and 2, respectively.

As described above, the display driver integrated circuit 200 according to an embodiment of the disclosure may perform control such that the optical characteristics of intermediate driving frequencies are the same as or similar to the optical characteristics of the current driving frequency and the target driving frequency by allocating a shorter light emission cycle (the cycle interval becoming shorter by allocating more on-off periods for one frame operation) in a state where the luminance value of the display panel 160 is relatively low, and allocate a longer light emission cycle (e.g., the cycle interval becoming longer by allocating fewer on-off periods to one frame operation) in a state where the luminance value of the display panel 160 is relatively high.

On the other hand, the number and values of intermediate frequencies, values of the VFPs, and values of the light emission cycles described in FIG. 6 may vary depending on the size, characteristics, usage time, or the type of content to be displayed of the display panel 160.

FIG. 7 is a diagram illustrating setting VFPs, light emission cycles, and AORs in a driving method for a display according to an embodiment of the disclosure.

Referring to FIG. 7, as in 701, the display driver integrated circuit 200 according to an embodiment of the disclosure may perform control such that, if the driving frequency change (e.g., change from 60 Hz to 120 Hz) is requested in a state in which the luminance value of the display panel 160 is 420 nit, the driving frequency is changed to the target driving frequency through 70 Hz, 100 Hz, and 110 Hz. In this operation, the display driver integrated circuit 200 may allocate 914, 296, and 135 to the VFPs of the intermediate driving frequencies of 70 Hz, 100 Hz, and 110 Hz, respectively, may allocate 4, 2, 2, 2, and 2 cycles to the driving frequencies of 60 Hz, 70 Hz, 100 Hz, 110 Hz, and 120 Hz, respectively, for the light emission cycle, and may allocate 45%, 46%, 47%, 46%, and 45% to the driving frequencies of 60 Hz, 70 Hz, 100 Hz, 110 Hz, and 120 Hz, respectively, for the AMOLED off ratios (AORs). The display driver integrated circuit 200 may perform control such that, if the driving frequency change (e.g., change from 60 Hz to 120 Hz) is requested in a state in which the luminance value of the display panel 160 is 100 nit, the driving frequency is changed to the target driving frequency through 70 Hz and 110 Hz. In this operation, the display driver integrated circuit 200 may allocate 900 and 100 to the VFPs of the intermediate driving frequencies of 70 Hz and 110 Hz, respectively, may allocate 4, 4, 4, and 2 cycles to the driving frequencies of 60 Hz, 70 Hz, 110 Hz, and 120 Hz, respectively, for the light emission cycle, and may allocate 45%, 46%, 47%, and 45% to the driving frequencies of 60 Hz, 70 Hz, 110 Hz, and 120 Hz, respectively, for the AMOLED off ratios (AORs). As described above, if the luminance value of the display panel 160 is relatively low, the display driver integrated circuit 200 may allocate fewer intermediate driving frequencies, allocate fewer VFP values, allocate shorter light emission cycles, and allocate greater AOR change rates.

According to various embodiments of the disclosure, as in 703, the display driver integrated circuit 200 may allocate 420 nit and 100 nit to intermediate driving frequencies of the same number and values, but may set respective VFPs, light emission cycles, and AOR values differently. In this operation, display anomalies, such as flicker are less observed at a relatively low luminance value of the display panel 160, and thus the display driver integrated circuit 200 may set the holding time (VFP) of one frame the period of the light emission cycle to be shorter, and may set the AOR change rate to be larger. Here, the holding time of the frame, the light emission cycle, and the AOR change rate may be adjusted within a range in which the luminance value of the display panel 160 at the corresponding intermediate driving frequency is the same as or similar to the luminance value of the display panel 160 at an adjacent intermediate driving frequency.

FIG. 8 is a diagram illustrating setting gamma correction tables in a driving method for a display according to an embodiment of the disclosure.

Referring to FIG. 8, as in 801, the display driver integrated circuit 200 according to an embodiment of the disclosure may perform control such that, if the driving frequency change (e.g., change from 60 Hz to 120 Hz) is requested in a state in which the luminance value of the display panel 160 is 420 nit, the driving frequency is changed to the target driving frequency through 70 Hz, 100 Hz, and 110 Hz. In this operation, regarding gamma correction tables of the driving frequencies, the display driver integrated circuit 200 may apply a 60 Hz gamma correction table at the driving frequency of 60 Hz, may apply a 60 Hz gamma correction table at the driving frequency of 70 Hz, and may apply, at the driving frequency of 100 Hz, the 60 Hz gamma correction table for values exceeding (or equal to or less than) 202 G (202 gray based on 256 grayscale), or apply a 120 Hz gamma correction table for values of 202 G or less (or below 202 G). In addition, at the driving frequency of 110 Hz, the display driver integrated circuit 200 may apply the 120 Hz gamma correction table for values exceeding (or equal to or less than) 202 G and apply a new gamma correction table for values of 202 G or less (or below 202 G), and at the driving frequency of 120 Hz, may apply the 120 Hz gamma correction table. In this regard, in the second memory 210 of the display driver integrated circuit 200, a first gamma correction table (or the 60 Hz gamma correction table) may be stored when applied at the driving frequency of 60 Hz, and a second gamma correction table (or the 120 Hz gamma correction table) may be stored when applied at the driving frequency of 120 Hz. Additionally or alternatively, the new gamma correction table may include a gamma correction table generated by using the first gamma correction table and the second gamma correction table (e.g., a table consisting of arithmetic mean values of gamma values of the first gamma correction table and the gamma values of the second gamma correction table). In this operation, the display driver integrated circuit 200 may allocate 914, 296, and 135 to VFP values of the intermediate driving frequencies (e.g., 70 Hz, 100 Hz, and 110 Hz), respectively. Additionally, the display driver integrated circuit 200 may allocate 8 to the value of the VFP of the 60 Hz driving frequency or the 120 Hz driving frequency. The 202 grayscale in the application of the gamma correction tables described above is arbitrary statistical data, and may be changed to a different value (e.g., 180 grayscale, 200 grayscale, and so on) depending on at least one of a characteristic or usage time of the display panel 160, a type of output content, and a user setting.

According to various embodiments of the disclosure, as in the state of 803, the display driver integrated circuit 200 may allocate two intermediate driving frequencies of 70 Hz and 110 Hz if the driving frequency change (e.g., the change from 60 Hz to 120 Hz) is requested in a state in which the luminance value of the display panel 160 is 100 nit, and may deal with application of gamma correction tables to the respective driving frequencies. In this operation, for the intermediate driving frequency of 110 Hz, the display driver integrated circuit 200 may apply the 120 Hz gamma correction table for grayscale values exceeding 202 G and may apply the 60 Hz gamma correction table for grayscale values of 202 G or less. In this regard, the second memory 210 may store the 60 Hz gamma correction table and the 120 Hz gamma correction table, respectively.

FIG. 9 is a diagram illustrating settings depending on driving frequency change directions in a driving method for a display according to an embodiment of the disclosure.

Referring to FIG. 9, as in 901, the display driver integrated circuit 200 according to an embodiment of the disclosure may perform control such that, if the driving frequency change (e.g., change from 60 Hz to 120 Hz) is requested in a state in which the luminance value of the display panel 160 is 50 nit, the driving frequency is changed to the target driving frequency through 70 Hz, 100 Hz, and 110 Hz. In this operation, the display driver integrated circuit 200 may allocate 914, 296, and 135 to VFPs of the intermediate driving frequencies 70 Hz, 100 Hz, and 110 Hz, and may allocate 4, 4, and 4 (frames) to the holding times (e.g., the numbers of frames displayed as the driving frequency) of the driving frequencies.

As in 903, the display driver integrated circuit 200 according to various embodiments of the disclosure may perform control such that, if the driving frequency change (e.g., change from 120 Hz to 60 Hz) is requested in a state in which the luminance value of the display panel 160 is 50 nit, the driving frequency is changed to the target driving frequency through 70 Hz, 100 Hz, and 110 Hz; here, the display driver integrated circuit 200 may allocate 914, 296, and 135 to VFPs of the intermediate driving frequencies 70 Hz, 100 Hz, and 110 Hz, and may allocate 8, 8, and 8 (frames) to the holding times (e.g., numbers of frames displayed as the corresponding driving frequencies) of the driving frequencies.

As described above, the display driver integrated circuit 200 may set the change time (or response speed) to the target driving frequency to be short by keeping the frame holding time short if the driving frequency is changed from a relatively low driving frequency to a relatively high driving frequency, and may reduce the level of fatigue caused by the frequency change of the display panel 160 by keeping the frame holding time long if the driving frequency is changed from a relatively high driving frequency to a relatively low driving frequency.

Meanwhile, in the above description, the intermediate driving frequencies have been described as being allocated in the same number in the change directions of the driving frequencies (e.g., the direction from a high value to a low value or the direction from a low value to a high value); however, the disclosure is limited thereto. For example, the display driver integrated circuit 200 may allocate a relatively fewer number of intermediate driving frequencies if the driving frequency is changed from a relatively high driving frequency to a relatively low driving frequency. In addition, the display driver integrated circuit 200 may allocate more VFP values if the driving frequency is changed from a relatively high driving frequency to a relatively low driving frequency, and may allocate fewer VFP values if the driving frequency is changed from a relatively low driving frequency to a relatively high driving frequency.

FIG. 10 is a diagram illustrating setting a driving frequency according to application of a range value in a driving method for a display according to an embodiment of the disclosure.

Referring to FIG. 10, the display driver integrated circuit 200 according to an embodiment of the disclosure may perform control such that, if the driving frequency change (e.g., change from 60 Hz to 120 Hz) is requested in a state in which the luminance value of the display panel 160 is below 15 nit or 500 nit or more, the driving frequency is directly changed from 60 Hz to 120 Hz without allocating any separate intermediate driving frequency. According to various embodiments of the disclosure, the display driver integrated circuit 200 may omit allocation operations of light emission cycles and AORs to intermediate driving frequencies. Additionally or alternatively, the display driver integrated circuit 200 may omit allocation operations of the VFPs and gamma correction tables to intermediate driving frequencies.

Meanwhile, in the above description, regarding driving speed control, the VFP (setting of the holding time of one frame) has been described; however, the display driver integrated circuit 200 may adjust the driving speed by adjusting the 1H time. In the operation, the display driver integrated circuit 200 may set the 1H time of each of the driving frequencies to be relatively long if the luminance value of the display panel 160 is relatively high (or short), and may set the 1H hour of each of the driving frequencies to be relatively short if the luminance value of the display panel 160 is relatively low (or long).

As described above, the electronic device according to an embodiment of the disclosure may include a display panel, and a display driver integrated circuit that receives a request for changing a current driving frequency of the display panel to a target driving frequency, determines whether the luminance value of the display panel is within specified first and second sizes, and then determines at least one intermediate driving frequency between the current driving frequency and the target driving frequency depending on the luminance value of the display panel if the luminance value of the display panel is within the first size and the second size.

Alternatively, the electronic device according to an embodiment of the disclosure may include a display panel and a display driver integrated circuit configured to receive a request for changing a current driving frequency of the display panel to a target driving frequency, determine whether the luminance value of the display panel is less than or equal to a specified first size or equal to or greater than a second size, and then determine at least one intermediate driving frequency between the current driving frequency and the target driving frequency depending on the luminance value of the display panel if the luminance value of the display panel exceeds the first size and less than the second size and omit the determination of the at least one intermediate driving frequency if the luminance value of the display panel is less than or equal to the first size or equal to or greater than the second size.

According to various embodiments of the disclosure, an electronic device may include a display panel and a display driver integrated circuit configured to drive the display panel. The display driver integrated circuit may be configured to determine a luminance value of the display panel if a request for a change from a current driving frequency of the display panel to a target driving frequency is received, and determine at least one intermediate driving frequency between the current driving frequency and the target driving frequency depending on the luminance value of the display panel.

According to various embodiments of the disclosure, the display driver integrated circuit may be configured to differently determine at least one of the number of the at least one intermediate driving frequency, a value of the at least one intermediate driving frequency, and a holding time of the at least one intermediate driving frequency, depending on the luminance value of the display panel.

According to various embodiments of the disclosure, the display driver integrated circuit may be configured to allocate a greater number of the at least one intermediate driving frequency as the luminance value of the display panel increases.

According to various embodiments of the disclosure, the display driver integrated circuit may be configured to allocate a smaller number of the at least one intermediate driving frequency as the luminance value of the display panel decreases.

According to various embodiments of the disclosure, the display driver integrated circuit may be configured to allocate a shorter holding time of the at least one intermediate driving frequency as the luminance value of the display panel increases.

According to various embodiments of the disclosure, the display driver integrated circuit may be configured to allocate a longer holding time of the at least one intermediate driving frequency as the luminance value of the display panel decreases.

According to various embodiments of the disclosure, the display driver integrated circuit may be configured to differently determine a first intermediate driving frequency and a second intermediate driving frequency in a situation in which the luminance value of the display panel is the same, the first intermediate driving frequency being allocated when the current driving frequency is greater than the target driving frequency, the second intermediate driving frequency being allocated when the current driving frequency is smaller than the target driving frequency.

According to various embodiments of the disclosure, the display driver integrated circuit may be configured to differently determine the number of frame outputs of the first intermediate driving frequency and the number of frame outputs of the second intermediate driving frequency.

According to various embodiments of the disclosure, the display driver integrated circuit may control the luminance value of the display panel to be maintained within a predetermined range while the current driving frequency is changed to the target driving frequency through the determined at least one intermediate driving frequency.

According to various embodiments of the disclosure, the display driver integrated circuit may be configured to adjust at least one of a light emission cycle of the display panel at the at least one intermediate driving frequency, a gamma correction table at the at least one intermediate driving frequency, an off ratio of pixels of the display panel, and a driving speed of the display panel, such that the luminance value of the display panel at the at least one intermediate driving frequency is the same or similar to the luminance value at the current driving frequency of the display panel.

According to various embodiments of the disclosure, the electronic device may further include a memory storing adjustment tables for adjusting at least one of the light emission cycle of the display panel at the at least one intermediate driving frequency, the gamma correction table at the at least one intermediate driving frequency, the off ratio of pixels of the display panel, and the driving speed of the display panel.

According to various embodiments of the disclosure, the display driver integrated circuit may be configured to set the light emission cycle at the at least one intermediate driving frequency to be smaller as the luminance value of the display panel increases, and set the light emission cycle at the at least one intermediate driving frequency to be greater as the luminance value of the display panel decreases.

According to various embodiments of the disclosure, the display driver integrated circuit may be configured to use a first gamma correction table related to driving the display panel at the current driving frequency and a second gamma correction table related to driving the display panel at the target driving frequency for the gamma correction of the at least one intermediate driving frequency.

According to various embodiment of the disclosure, the display driver integrated circuit may be configured to omit application of the at least one intermediate driving frequency if the luminance value of the display panel is less than or equal to a specified first size or equal to or greater than a specified second size.

According to various embodiments of the disclosure, a driving method for a display may include receiving, by a display driver integrated circuit, a request for a change from a current driving frequency of a display panel to a target driving frequency, determining, by the display driver integrated circuit, a luminance value of the display panel, and determining, by the display driver integrated circuit, at least one intermediate driving frequency between the current driving frequency and the target driving frequency depending on the luminance value of the display panel.

According to various embodiment of the disclosure, the determining may include differently determining at least one of the number of the at least one intermediate driving frequency, a value of the at least one intermediate driving frequency, and a holding time of the at least one intermediate driving frequency, depending on the luminance value of the display panel.

According to various embodiments of the disclosure, the method may further include controlling the luminance value of the display panel to be maintained within a predetermined range while the current driving frequency is changed to the target driving frequency through the determined at least one intermediate driving frequency.

According to various embodiments of the disclosure, the controlling may include adjusting at least one of the light emission cycle of the display panel at the at least one intermediate driving frequency, the gamma correction table at the at least one intermediate driving frequency, the off ratio of pixels of the display panel, and the driving speed of the display panel.

According to various embodiments of the disclosure, the adjusting may be performed based on adjustment tables for adjusting at least one of the light emission cycle of the display panel at the at least one intermediate driving frequency, the gamma correction table at the at least one intermediate driving frequency, the off ratio of pixels of the display panel, and the driving speed of the display panel, which are stored in a memory.

According to various embodiments of the disclosure, the method may further include determining whether the luminance value of the display panel is less than or equal to a specified first size or equal to or greater than a specified second size, and omitting determination of the at least one intermediate driving frequency according to the determination.

According to various embodiments of the disclosure, the method may further include, by the display driver integrated circuit, allocating a greater number of the at least one intermediate driving frequency as the luminance value of the display panel increases.

According to various embodiments of the disclosure, the method may further include, by the display driver integrated circuit, allocating a smaller number of the at least one intermediate driving frequency as the luminance value of the display panel decreases.

According to various embodiments of the disclosure, the method may further include, by the display driver integrated circuit, allocating a shorter holding time of the at least one intermediate driving frequency as the luminance value of the display panel increases.

According to various embodiments of the disclosure, the method may further include, by the display driver integrated circuit, allocating a longer holding time of the at least one intermediate driving frequency as the luminance value of the display panel decreases.

Figure 11:
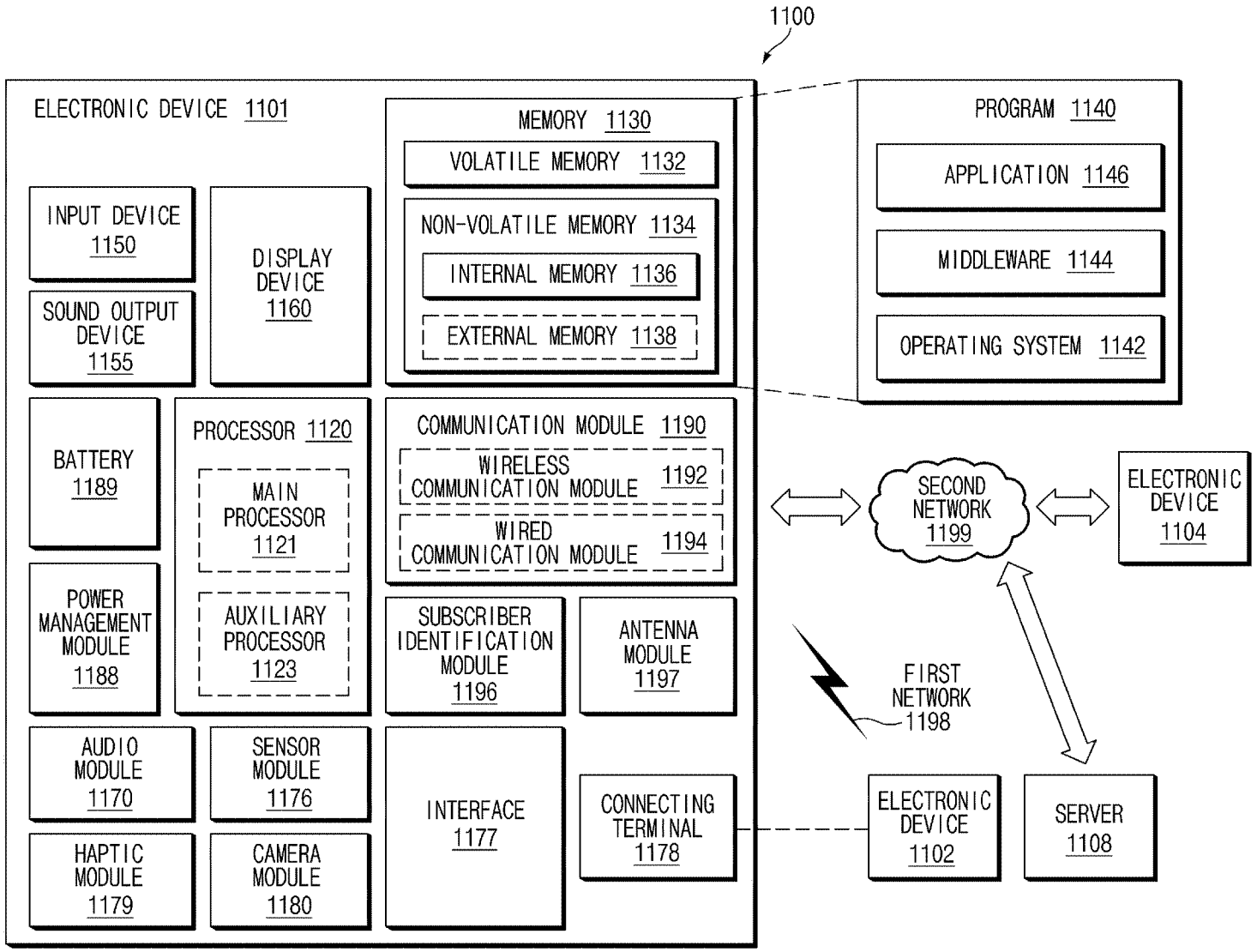
FIG. 11 is a block diagram illustrating an electronic device 1101 in a network environment 1100 according to an embodiment of the disclosure.

FIG. 11 is a block diagram illustrating an electronic device 1101 in a network environment 1100 according to an embodiment of the disclosure.

Referring to FIG. 11, the electronic device 1101 in the network environment 1100 may communicate with an electronic device 1102 via a first network 1198 (e.g., a short-range wireless communication network), or at least one of an electronic device 1104 or a server 1108 via a second network 1199 (e.g., a long-range wireless communication network). According to an embodiment of the disclosure, the electronic device 1101 may communicate with the electronic device 1104 via the server 1108. According to an embodiment of the disclosure, the electronic device 1101 may include a processor 1120, memory 1130, an input module 1150, a sound output module 1155, a display module 1160, an audio module 1170, a sensor module 1176, an interface 1177, a connecting terminal 1178, a haptic module 1179, a camera module 1180, a power management module 1188, a battery 1189, a communication module 1190, a subscriber identification module (SIM) 1196, or an antenna module 1197. In some embodiments of the disclosure, at least one of the components (e.g., the connecting terminal 1178) may be omitted from the electronic device 1101, or one or more other components may be added in the electronic device 1101. In some embodiments of the disclosure, some of the components (e.g., the sensor module 1176, the camera module 1180, or the antenna module 1197) may be implemented as a single component (e.g., the display module 1160).

The processor 1120 may execute, for example, software (e.g., a program 1140) to control at least one other component (e.g., a hardware or software component) of the electronic device 1101 coupled with the processor 1120, and may perform various data processing or computation. According to one embodiment of the disclosure, as at least part of the data processing or computation, the processor 1120 may store a command or data received from another component (e.g., the sensor module 1176 or the communication module 1190) in volatile memory 1132, process the command or the data stored in the volatile memory 1132, and store resulting data in non-volatile memory 1134. According to an embodiment of the disclosure, the processor 1120 may include a main processor 1121 (e.g., a central processing unit (CPU) or an application processor (AP)), or an auxiliary processor 1123 (e.g., a graphics processing unit (GPU), a neural processing unit (NPU), an image signal processor (ISP), a sensor hub processor, or a communication processor (CP)) that is operable independently from, or in conjunction with, the main processor 1121. For example, when the electronic device 1101 includes the main processor 1121 and the auxiliary processor 1123, the auxiliary processor 1123 may be adapted to consume less power than the main processor 1121, or to be specific to a specified function. The auxiliary processor 1123 may be implemented as separate from, or as part of the main processor 1121.

The auxiliary processor 1123 may control at least some of functions or states related to at least one component (e.g., the display module 1160, the sensor module 1176, or the communication module 1190) among the components of the electronic device 1101, instead of the main processor 1121 while the main processor 1121 is in an inactive (e.g., sleep) state, or together with the main processor 1121 while the main processor 1121 is in an active state (e.g., executing an application). According to an embodiment of the disclosure, the auxiliary processor 1123 (e.g., an image signal processor or a communication processor) may be implemented as part of another component (e.g., the camera module 1180 or the communication module 1190) functionally related to the auxiliary processor 1123. According to an embodiment of the disclosure, the auxiliary processor 1123 (e.g., the neural processing unit) may include a hardware structure specified for artificial intelligence model processing. An artificial intelligence model may be generated by machine learning. Such learning may be performed, e.g., by the electronic device 1101 where the artificial intelligence is performed or via a separate server (e.g., the server 1108). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 1130 may store various data used by at least one component (e.g., the processor 1120 or the sensor module 1176) of the electronic device 1101. The various data may include, for example, software (e.g., the program 1140) and input data or output data for a command related thereto. The memory 1130 may include the volatile memory 1132 or the non-volatile memory 1134.

The program 1140 may be stored in the memory 1130 as software, and may include, for example, an operating system (OS) 1142, middleware 1144, or an application 1146.

The input module 1150 may receive a command or data to be used by another component (e.g., the processor 1120) of the electronic device 1101, from the outside (e.g., a user) of the electronic device 1101. The input module 1150 may include, for example, a microphone, a mouse, a keyboard, a key (e.g., a button), or a digital pen (e.g., a stylus pen).

The sound output module 1155 may output sound signals to the outside of the electronic device 1101. The sound output module 1155 may include, for example, a speaker or a receiver. The speaker may be used for general purposes, such as playing multimedia or playing record. The receiver may be used for receiving incoming calls. According to an embodiment of the disclosure, the receiver may be implemented as separate from, or as part of the speaker.

The display module 1160 may visually provide information to the outside (e.g., a user) of the electronic device 1101. The display module 1160 may include, for example, a display, a hologram device, or a projector and control circuitry to control a corresponding one of the display, hologram device, and projector. According to an embodiment of the disclosure, the display module 1160 may include a touch sensor adapted to detect a touch, or a pressure sensor adapted to measure the intensity of force incurred by the touch.

The audio module 1170 may convert a sound into an electrical signal and vice versa. According to an embodiment of the disclosure, the audio module 1170 may obtain the sound via the input module 1150, or output the sound via the sound output module 1155 or a headphone of an external electronic device (e.g., an electronic device 1102) directly (e.g., wiredly) or wirelessly coupled with the electronic device 1101.

The sensor module 1176 may detect an operational state (e.g., power or temperature) of the electronic device 1101 or an environmental state (e.g., a state of a user) external to the electronic device 1101, and then generate an electrical signal or data value corresponding to the detected state. According to an embodiment of the disclosure, the sensor module 1176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1177 may support one or more specified protocols to be used for the electronic device 1101 to be coupled with the external electronic device (e.g., the electronic device 1102) directly (e.g., wiredly) or wirelessly. According to an embodiment of the disclosure, the interface 1177 may include, for example, a high definition multimedia interface (HDMI), a universal serial bus (USB) interface, a secure digital (SD) card interface, or an audio interface.

A connecting terminal 1178 may include a connector via which the electronic device 1101 may be physically connected with the external electronic device (e.g., the electronic device 1102). According to an embodiment of the disclosure, the connecting terminal 1178 may include, for example, a HDMI connector, a USB connector, a SD card connector, or an audio connector (e.g., a headphone connector).

The haptic module 1179 may convert an electrical signal into a mechanical stimulus (e.g., a vibration or a movement) or electrical stimulus which may be recognized by a user via his tactile sensation or kinesthetic sensation. According to an embodiment of the disclosure, the haptic module 1179 may include, for example, a motor, a piezoelectric element, or an electric stimulator.

The camera module 1180 may capture a still image or moving images. According to an embodiment of the disclosure, the camera module 1180 may include one or more lenses, image sensors, image signal processors, or flashes.

The power management module 1188 may manage power supplied to the electronic device 1101. According to one embodiment of the disclosure, the power management module 1188 may be implemented as at least part of, for example, a power management integrated circuit (PMIC).

The battery 1189 may supply power to at least one component of the electronic device 1101. According to an embodiment of the disclosure, the battery 1189 may include, for example, a primary cell which is not rechargeable, a secondary cell which is rechargeable, or a fuel cell.

The communication module 1190 may support establishing a direct (e.g., wired) communication channel or a wireless communication channel between the electronic device 1101 and the external electronic device (e.g., the electronic device 1102, the electronic device 1104, or the server 1108) and performing communication via the established communication channel. The communication module 1190 may include one or more communication processors that are operable independently from the processor 1120 (e.g., the application processor (AP)) and supports a direct (e.g., wired) communication or a wireless communication. According to an embodiment of the disclosure, the communication module 1190 may include a wireless communication module 1192 (e.g., a cellular communication module, a short-range wireless communication module, or a global navigation satellite system (GNSS) communication module) or a wired communication module 1194 (e.g., a local area network (LAN) communication module or a power line communication (PLC) module). A corresponding one of these communication modules may communicate with the external electronic device via the first network 1198 (e.g., a short-range communication network, such as Bluetooth™, wireless-fidelity (Wi-Fi) direct, or infrared data association (IrDA)) or the second network 1199 (e.g., a long-range communication network, such as a legacy cellular network, a $5^{th}$ generation (5G) network, a next-generation communication network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 1192 may identify and authenticate the electronic device 1101 in a communication network, such as the first network 1198 or the second network 1199, using subscriber information (e.g., international mobile subscriber identity (IMSI)) stored in the subscriber identification module 1196.

The antenna module 1197 may transmit or receive a signal or power to or from the outside (e.g., the external electronic device) of the electronic device 1101. According to an embodiment of the disclosure, the antenna module 1197 may include an antenna including a radiating element including a conductive material or a conductive pattern formed in or on a substrate (e.g., a printed circuit board (PCB)). According to an embodiment of the disclosure, the antenna module 1197 may include a plurality of antennas (e.g., array antennas). In such a case, at least one antenna appropriate for a communication scheme used in the communication network, such as the first network 1198 or the second network 1199, may be selected, for example, by the communication module 1190 (e.g., the wireless communication module 1192) from the plurality of antennas. The signal or the power may then be transmitted or received between the communication module 1190 and the external electronic device via the selected at least one antenna. According to an embodiment of the disclosure, another component (e.g., a radio frequency integrated circuit (RFIC)) other than the radiating element may be additionally formed as part of the antenna module 1197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment of the disclosure, commands or data may be transmitted or received between the electronic device 1101 and the external electronic device 1104 via the server 1108 coupled with the second network 1199. Each of the electronic devices 1102 or 1104 may be a device of a same type as, or a different type, from the electronic device 1101. According to an embodiment of the disclosure, all or some of operations to be executed at the electronic device 1101 may be executed at one or more of the external electronic devices 1102, 1104, or 1108. For example, if the electronic device 1101 should perform a function or a service automatically, or in response to a request from a user or another device, the electronic device 1101, instead of, or in addition to, executing the function or the service, may request the one or more external electronic devices to perform at least part of the function or the service.

The one or more external electronic devices receiving the request may perform the at least part of the function or the service requested, or an additional function or an additional service related to the request, and transfer an outcome of the performing to the electronic device 1101. The electronic device 1101 may provide the outcome, with or without further processing of the outcome, as at least part of a reply to the request. To that end, a cloud computing, distributed computing, mobile edge computing (MEC), or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used in connection with various embodiments of the disclosure, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment of the disclosure, the module may be implemented in a form of an application-specific integrated circuit (ASIC).

Various embodiments as set forth herein may be implemented as software (e.g., the program 1140) including one or more instructions that are stored in a storage medium (e.g., internal memory 1136 or external memory 1138) that is readable by a machine (e.g., the electronic device 1101). For example, a processor (e.g., the processor 1120) of the machine (e.g., the electronic device 1101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment of the disclosure, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments of the disclosure, each component (e.g., a module or a program) of the above-described components may include a single entity or multiple entities, and some of the multiple entities may be separately disposed in different components. According to various embodiments of the disclosure, one or more of the above-described components may be omitted, or one or more other components may be added. Alternatively or additionally, a plurality of components (e.g., modules or programs) may be integrated into a single component. In such a case, according to various embodiments of the disclosure, the integrated component may still perform one or more functions of each of the plurality of components in the same or similar manner as they are performed by a corresponding one of the plurality of components before the integration. According to various embodiments of the disclosure, operations performed by the module, the program, or another component may be carried out sequentially, in parallel, repeatedly, or heuristically, or one or more of the operations may be executed in a different order or omitted, or one or more other operations may be added.

While the disclosure has been shown and described with reference to various embodiments thereof, it will be understood by those skilled in the art that various changes in form and details may be made therein without departing from the spirit and scope of the disclosure as defined by the appended claims and their equivalents.

The invention claimed is:

1. An electronic device comprising:

a display panel; and a display driver integrated circuit configured to drive the display panel, wherein the display driver integrated circuit is further configured to:

determine a luminance value of the display panel when a signal corresponding to a request for a change from a current driving frequency of the display panel to a target driving frequency is received, and determine at least one intermediate driving frequency between the current driving frequency and the target driving frequency depending on the luminance value of the display panel, and wherein the display driver integrated circuit is further configured to differently allocate a number of the at least one intermediate driving frequency according to the luminance value of the display panel.

2. The electronic device of claim 1, wherein the display driver integrated circuit is further configured to differently allocate at least one of a value of the at least one intermediate driving frequency, or a holding time of the at least one intermediate driving frequency, depending on the luminance value of the display panel.

3. The electronic device of claim 2, wherein the display driver integrated circuit is further configured to allocate a shorter holding time of the at least one intermediate driving frequency as the luminance value of the display panel increases.

4. The electronic device of claim 2, wherein the display driver integrated circuit is further configured to allocate a longer holding time of the at least one intermediate driving frequency as the luminance value of the display panel decreases.

5. The electronic device of claim 2, wherein the display driver integrated circuit is further configured to differently determine a first intermediate driving frequency and a second intermediate driving frequency in a situation in which the luminance value of the display panel is the same, the first intermediate driving frequency being allocated when the current driving frequency is greater than the target driving frequency, the second intermediate driving frequency being allocated when the current driving frequency is smaller than the target driving frequency.

6. The electronic device of claim 5, wherein the display driver integrated circuit is further configured to differently determine a number of frame outputs of the first intermediate driving frequency and the number of frame outputs of the second intermediate driving frequency.

7. The electronic device of claim 1, wherein the display driver integrated circuit is further configured to allocate a greater number of the at least one intermediate driving frequency as the luminance value of the display panel increases.

8. The electronic device of claim 1, wherein the display driver integrated circuit is further configured to allocate a smaller number of the at least one intermediate driving frequency as the luminance value of the display panel decreases.

9. The electronic device of claim 1, wherein the display driver integrated circuit is further configured to control the luminance value of the display panel to be maintained within a predetermined range while the current driving frequency is changed to the target driving frequency through the determined at least one intermediate driving frequency.

10. The electronic device of claim 9, wherein the display driver integrated circuit is further configured to adjust at least one of a light emission cycle of the display panel at the at least one intermediate driving frequency, a gamma correction table at the at least one intermediate driving frequency, an off ratio of pixels of the display panel, or a driving speed of the display panel, such that the luminance value of the display panel at the at least one intermediate driving frequency is the same or similar to the luminance value at the current driving frequency of the display panel.

11. The electronic device of claim 10, further comprising:

a memory storing at least one of adjustment tables for adjusting at least one of the light emission cycle of the display panel at the at least one intermediate driving frequency, the gamma correction table at the at least one intermediate driving frequency, the off ratio of pixels of the display panel, or the driving speed of the display panel.

12. The electronic device of claim 11, wherein the display driver integrated circuit is further configured to:

set the light emission cycle at the at least one intermediate driving frequency to be smaller as the luminance value of the display panel increases, and set the light emission cycle at the at least one intermediate driving frequency to be greater as the luminance value of the display panel decreases.

13. The electronic device of claim 11, wherein the display driver integrated circuit is further configured to use a first gamma correction table related to driving the display panel at the current driving frequency and a second gamma correction table related to driving the display panel at the target driving frequency for the gamma correction of the at least one intermediate driving frequency.

14. The electronic device of claim 1, wherein the display driver integrated circuit is further configured to omit application of the at least one intermediate driving frequency when the luminance value of the display panel is less than or equal to a specified first size or equal to or greater than a specified second size.

15. A driving method for a display, the method comprising:

receiving, by a display driver integrated circuit, a signal corresponding to a request for a change from a current driving frequency of a display panel to a target driving frequency;

determining, by the display driver integrated circuit, a luminance value of the display panel with the receiving of the signal; and determining, by the display driver integrated circuit, at least one intermediate driving frequency between the current driving frequency and the target driving frequency depending on the luminance value of the display panel, differently allocating a number of the at least one intermediate driving frequency according to the luminance value of the display panel.

16. The method of claim 15, wherein the differently allocating includes differently allocating at least one of a value of the at least one intermediate driving frequency, or a holding time of the at least one intermediate driving frequency, depending on the luminance value of the display panel.

17. The method of claim 15, further comprising:

controlling the luminance value of the display panel to be maintained within a predetermined range while the current driving frequency is changed to the target driving frequency through the determined at least one intermediate driving frequency.

18. The method of claim 17, wherein the controlling of the luminance value of the display panel includes adjusting at least one of a light emission cycle of the display panel at the at least one intermediate driving frequency, a gamma correction table at the at least one intermediate driving frequency, an off ratio of pixels of the display panel, or a driving speed of the display panel.

19. The method of claim 18, wherein the adjusting is performed based on at least one of adjustment tables for adjusting at least one of the light emission cycle of the display panel at the at least one intermediate driving frequency, the gamma correction table at the at least one intermediate driving frequency, the off ratio of pixels of the display panel, or the driving speed of the display panel, which are stored in a memory.

20. The method of claim 15, further comprising:

determining whether the luminance value of the display panel is less than or equal to a specified first size or equal to or greater than a specified second size; and omitting determination of the at least one intermediate driving frequency according to the determination.

* * * * *